United States Patent [19]

Duling et al.

[11] 3,966,624

[45] June 29, 1976

[54] BLENDED TRACTION FLUID CONTAINING HYDROGENATED POLYOLEFIN AND AN ADAMANTANE ETHER

[75] Inventors: Irl N. Duling, West Chester; David S. Gates, Swarthmore; Frederick P. Glazier, Thornton, all of Pa.; Robert E. Moore, Wilmington, Del.; Thomas D. Newingham, Broomall, Pa.

[73] Assignee: Sun Oil Company of Pennsylvania, Philadelphia, Pa.

[22] Filed: July 15, 1971

[21] Appl. No.: 165,418

[52] U.S. Cl. ..... 252/52 R; 252/73

[51] Int. Cl.[2] ..... C10M 1/20

[58] Field of Search ..... 252/59, 52, 58, 57, 252/73, 79; 260/666 M

[56] References Cited

UNITED STATES PATENTS

| | | | |
|---|---|---|---|
| 3,156,652 | 11/1964 | Foehr | 252/75 X |
| 3,242,068 | 3/1966 | Paterson | 208/111 |
| 3,275,559 | 9/1966 | Henry et al. | 252/77 X |
| 3,394,603 | 7/1968 | Rounds | 74/200 |
| 3,411,369 | 11/1968 | Hammann et al. | 74/200 |
| 3,450,636 | 6/1969 | Rausch | 252/75 |
| 3,493,505 | 2/1970 | Ries et al. | 252/73 X |
| 3,562,145 | 2/1971 | Franz et al. | 208/96 |
| 3,595,796 | 7/1971 | Duling et al. | 252/73 |
| 3,597,358 | 8/1971 | Duling et al. | 252/73 |
| 3,645,902 | 2/1972 | Duling et al. | 252/52 |
| 3,648,531 | 3/1972 | Duling et al. | 252/52 R X |

FOREIGN PATENTS OR APPLICATIONS

| | | |
|---|---|---|
| 1,806,401 | 10/1968 | Germany |

OTHER PUBLICATIONS

Gruse et al., "Chemical Technology of Petroleum," 2nd Edn. (1942), pp. 5–9.

Rounds, "Jour. Chemical & Engineering Data," vol. 5, No. 4, Oct. 1960, pp. 499–507.

*Primary Examiner*—Delbert E. Gantz
*Assistant Examiner*—Andrew H. Metz
*Attorney, Agent, or Firm*—J. Edward Hess; Donald R. Johnson; Paul Lipsitz

[57] ABSTRACT

A composition useful as a base stock for a lubricant in a traction drive transmission has a kinematic viscosity at 210°F in the range of 1.5–200.0 cs. and contains A. from 1–25 parts by weight of a hydrogenated polymer of $C_3$–$C_8$ aliphatic monoolefin, said polymer having an average molecular weight in the range of 180–2000, and B. one part by weight of at least one member selected from i. at least one saturated adamantane compound, said adamantane compound containing no elements other than carbon, hydrogen, fluorine and oxygen, wherein said oxygen is combined in an ether or an ester linkage or is in a carboxylic acid, hydroxyl or carbonyl group;

ii. a paraffinic petroleum oil containing less than 1% by weight of aromatics and having an ultraviolet absorptivity at 260 millimicrons of less than 0.5; and iii. a mixture of members from (i) and (ii).

7 Claims, 2 Drawing Figures

BLENDED TRACTION FLUID CONTAINING HYDROGENATED POLYOLEFIN AND AN ADAMANTANE ETHER

CROSS REFERENCES TO RELATED APPLICATIONS

This application is related to the following applications: Ser. No. 679,801, filed Nov. 1, 1967 of Duling, Gates, Moore and Glazier, now U.S. Pat. No. 3,597,358, issued Aug. 3, 1971; and Ser. No. 679,851, filed Nov. 1, 1967 of Duling, Gates and Newingham, now U.S. Pat. No. 3,598,740, issued Aug. 10, 1971.

BACKGROUND OF THE INVENTION

This invention relates generally to the use of certain naphthenes, partially saturated precursors of naphthenes, hydrorefined mineral oils, polyolefins and branched paraffins as traction fluids. The invention also relates to certain novel traction fluids having good low temperature properties comprising a mixture of at least one branched paraffin having a high viscosity index with at least one naphthene having a low viscosity index and a high traction coefficient. Preferably the blend of the paraffin and the naphthene has an average molecular weight in the range of 170–1000, more preferably 220–375. More preferably, the paraffin has a high degree of gem branching and a glass transition temperature in the range of 120° to −50°C. and the naphthene has a glass transition temperature (Tg) in the range of −90° to −30°C. The blended fluids of the present invention can contain any of the high traction naphthenic or partially saturated cyclic compounds described in U.S. Pat. Nos. 3,411,369 and 3,440,894. The blended fluids of the present invention can, in general, be superior in fluid and/or other lubricant properties (such as viscosity index) to the high traction components described in these two patents; furthermore, the process of such blending can allow for more flexability in choice of tractants for a given application. For example, a high traction component which has poor or unacceptable viscosity properties can be incorporated in a blend, as with a polyisobutylene oil, to produce a useable fluid having good traction and good fluid properties.

SUMMARY OF THE INVENTION

The invention will be described more particularly in connection with the combination of a power transmission system comprising a traction drive and as a lubricant therefor, a composition comprising a hydrocarbon base stock boiling mainly in the lube oil range and having a kinematic viscosity at 210°F. in the range of 1.5–200.0 cs., said base stock comprising a blend of a hydrogenated polymer of $C_3$–$C_8$ aliphatic monoolefin and an adamantane compound and/or a paraffinic petroleum oil (preferably hydrogenated) containing less than 1% of aromatics (by gel analysis).

Fluorine-substituted derivatives of any of the above hydrocarbons, wherein an average of from one to all of the hydrogen of the hydrocarbon is replaced by fluorine are also useful as traction fluids or components thereof, but are too expensive for most applications.

The invention includes a composition useful as a base stock for a lubricant in a traction drive transmission, said composition having a kinematic viscosity at 210°F in the range of 1.5–200.0 cs. and containing A. from 1–25 parts by weight of a hydrogenated polymer of $C_3$–$C_8$ aliphatic hydrocarbyl monoolefin, said polymer having an average molecular weight in the range of 180–2000, and B. one part by weight of at least one member selected from i. at least one saturated adamantane compound, said adamantane compound containing no elements other than carbon, hydrogen, fluorine and oxygen, wherein said oxygen is combined in an ether or an ester linkage or is in a carboxylic acid, hydroxyl or carbonyl group;

ii. a paraffinic petroleum oil containing less than 1% by weight of aromatics and having an ultraviolet absorptivity at 260 millimicrons of less than 0.5; and iii. a mixture of members from (i) and (ii).

In the composition the hydrogenated polymer of $C_3$–$C_8$ olefin can be a polymeric oil which is substantially free from unsaturation and has an average molecular weight in the range of 200–1000, and the polymeric oil can have a bromine number no greater than 5. The monoolefin can consist essentially of isobutylene. The composition can contain an adamantane compound selected from an ether having the formula

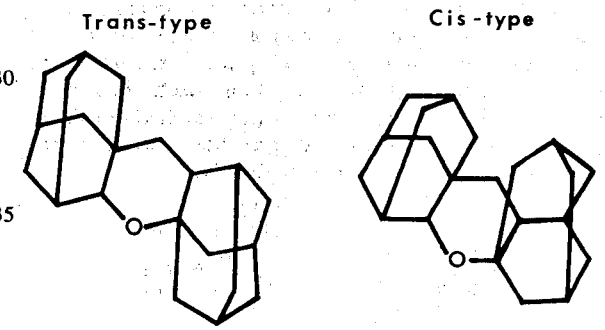

or can be an alkyl-substituted derivative of such an ether.

The said alkyl-substituted derivative can contain from 2–6 methyl groups, all attached to the bridgehead carbon atoms. In the composition there can be present from 1–25 parts by weight of the hydrogenated $C_3$–$C_8$ polymer oil and one part by weight of a mixture of members from (i) and (ii) said mixture containing from 10–90% of one or more members from group (i) and 90–10% of one or more members from group (ii).

It is to be understood, however, that in addition to the naphthenes and the branched paraffins described hereinafter (or fluorine-substituted derivatives thereof), such a lubricant can also contain other oils and additives (e.g., from 5 to 50 weight percent) such as an antifoam, a phosphorus-containing friction improver, a viscosity index improver (as a high molecular weight polyisobutylene), a pour point depressant (as a fluorine-containing, saturated polymeric olefin), a corrosion inhibitor (e.g., the alkylene glycol-pentaborate salt types), an anti-oxidant and a sludge dispersant. An especially useful additive, combining detergency, corrosion inhibition and friction improvement at high speeds, is a Mg, Ca or Ba salt (especially a super-based salt) of a weak acid or a partial ester of a weak acid, as thiophosphoric acids, phenols, diesters of phosphoric acid, sulfonated alkyl aromatic hydrocarbons and the like (e.g., super-based barium salts of dithiophosphoric acid, calcium alkyl phenates, and calcium salts of mahogany acids). In general, suitable additives are those having a "Friction Ratio" at 600 ft./min. (or higher) greater than 0.8 (preferably greater than 0.9). See Rounds, F. G., *J. C. J E Data*, 5, No. 4, 499–507 (1960), and the polar compounds described in the aforementioned applications of Driscoll and Baseltine, Jr. When the lubricant is applied in mist or aerosol form, the lubricant can contain, to improve reclassification or reduce stray fog, an effective amount (e.g., 0.01–2 weight percent of polymer) of a polymeric additive selected from one or a mixture of acyclic, methacrylic, olefin (e.g., isobutylene) and styrene (e.g., alphamethylstyrene) polymers having a viscosity average molecular weight in the range of 10,000–2,000,000 (preferably 100,000 to 500,000). Such additives are described in commonly-owned, co-pending application filed May 5, 1971 of Amaroso-Coppock-Newingham-Williams, entitled "Mist Lubricant Containing Polymeric Additive."

The art has long recognized a need for fluid lubricants having high dynamic coefficients of friction (e.g., greater than those possessed by naphthenic lube oils), and which are non-corrosive and are sufficiently stable to retain these properties under the severe stress to which such fluids are subjected during use.

Such "traction fluids" are important components of variable speed power transmission systems which utilize a traction drive or a friction clutch. In particular, the fluids of the present invention are useful in a traction transmission such as that of the attached drawings (Labelled FIG. 1 and FIG. 2) and those shown in the following publications and U.S. Pat. Nos.

| | |
|---|---|
| 1,867,553 | 3,184,990 |
| 2,549,377 | 3,225,617 |
| 2,871,714 | 3,268,041 |
| 3,006,206 | 3,301,364 |
| 3,115,049 | |

Kraus, C. E., ASME — Paper 65 — Md-30 (For New York N.Y. Meeting, May 17–20, 1956).

Hewko, L. O., AIAA Paper 67–429 (For AIAA 3rd Propulsion Joint Specialist Conference, Wash., D.C. July 17–21, 1967).

Such blended fluids are also useful in a controlled-slip differential (see the previously cited application of David S. Gates, Paul E. Hagstrom and Marcus W. Haseltine, Jr.).

As has been noted in U.S. Pat. No. 2,159,220, in the lubrication of continuous automatic variable speed power transmissions employing extremely high pressures between metal surfaces, such as at contact points between balls, rollers, and races, it is essential to avoid the use of a lubricant which will cause slipping between the surfaces at the contact points, thereby preventing the transmission of power through the mechanism. That is, such a lubricant must have a high dynamic coefficient or friction (or "traction coefficient") at elevated temperatures and high pressures. This requirement of a traction fluid is diametrically opposed to the requirement for those lubricants employed in ordinary extreme pressure lubrication, for example, in the lubrication of hypoid gears, metal cutting tools, etc., where a low traction coefficient is desired in order to obtain maximum lubrication at points of high pressure.

As has been noted in U.S. Pat. No. 2,549,377, the driving capacity of friction gears is a function of the coefficient of friction between the contacting surfaces and of the pressure which holds them in contact. Unsatisfactory performance of mineral oil, or of fluids containing mineral oil, when used to lubricate and prevent wear in friction gears, has been a key factor in limiting the applications to which friction drive torque converters have been adopted. That is, in the act of lubricating or preventing wear, a film of oil between the friction gear surfaces usually results in an increased slippage between the contact points of the surfaces of the engaging gears. The percent of slip increases drastically and even prohibitively with power input when ordinary high viscosity index mineral lubricating oils are employed.

The traction coefficient, or the dynamic coefficient of friction, which is one measure of the tractive capacity of a contact, can be defined as the ratio of the tangential force to the normal load under rolling-spinning motion. The limiting value of the coefficient of traction is the coefficient of traction at slip, which is observed when the rolling contact is on the verge of gross slip. In a given torque friction drive, coefficient of traction can be computed by knowing the normal load on the contact and by simultaneously measuring the input and output torques.

The essential qualifications of a friction gear transmission fluid comprise especially a high traction coefficient (which an ordinary lubricant does not possess), and an extremely high thermal stability and resistance to oxidation so as to minimize the necessity for fluid replacement. Another property which a torque converter fluid must exhibit is minimum sluding. Usually, those fluids which have been found to possess high traction coefficients in reference to steel on steel and also which have satisfactory stability and resistance to oxidation generally have high pour points and low viscosity indexes (VI) (e.g., −50 to −400 ASTM-VI); therefore, most traction fluids are not suitable for use at low temperatures. There is a special need for traction fluids having a high viscosity index, particularly for an ASTM-VI or VTF-VI greater than 40, and with a traction coefficient equal to or better than that of ASTM Oil No. 3.

Although there is not known means of predicting from structural or other chemical considerations whether a given fluid will be satisfactory for use as a lubricant in a traction drive, a fluid can be tested for an indication of its suitability as a traction fluid by utilizing such equipment and procedures as are described by Almen, J. O. in U.S. Pat. No. 2,045,555 or by Rounds, F. G., *Journal of CJE Data*, 5, No. 4, pp. 499–507 (1960), and *ASLE Transactions*, 7, 11–23 (1964). Of particular interest is the research traction test machine of Hewko, L. O. et al., in *Proceedings of the Symposium on Rolling Contact Phenomena*, pp. 157–185 (1962), Elsevier, Amsterdam, Netherlands. The torque measurement by a Roxana 4-ball tester can also be used to compare traction properties of various fluids.

As is noted in the Hewko paper, the fatigue life of a rolling contact element of a friction drive is inversely proportional to the third power of the load whereas the torque capacity is only directly proportional to the load. As a result, increasing the torque capacity through increasing the coefficient of traction is far more desirable than through increasing the normal load.

A comparatively small difference in traction coefficient can correspond to a large improvement in lubrication. For example, a 10% increase in the traction coefficient of the lubricant will increase the durability of the transmission by about 50%.

The coefficient of traction at a given r.p.m., temperature and contact pressure can vary somewhat depending upon the type of test equipment. Most of the traction fluids reported in the literature as having acceptable fluidity and traction properties are not specific chemical compounds of known purity and good stability. Therefore, it is difficult to reproduce or correlate the work reported by various investigators. A pressing need in this area is a "standard traction fluid" which can be used to correlate traction tests done in various types of transmission and test apparatus. ASTM Oil No. 3 can be used as such a standard.

1,3-(5,7-dimethyl)adamantyl dipelagonate (hereinafter sometimes DMAP) can also be useful as a standard traction fluid because it is readily prepared in high purity, has excellant stability, and has traction properties which are comparable to those of better naphthenic lube oils of the prior art (such as ASTM Oil No. 3). In addition, DMAP is more useful than those naphthenic lubes, as a traction fluid or as a component of a traction fluid, for traction drive automatic transmissions, because it has fluid properties (such as VI) which are greatly superior to those of the usual naphthenic lube oils (e.g., ASTM VI 95 v/s-11 for ASTM Oil No. 3). The preparation of DMAP is disclosed in U.S. Pat. No. 3,398,165, issued Aug. 20, 1968.

In general (except for oils having a viscosity at 210°C. below 2 cs.), if a fluid is to be useful as a lubricant for a given type of traction transmission, that fluid must have a traction coefficient in that particular transmission which is at least as high as the traction coefficient which ASTM Oil No. 3 has in the same transmission at the same test conditions. Therefore, one means of comparing traction fluids is to report their traction coefficients in a particular test (or the average traction coefficient as in FIG. 1) as being X% higher or lower than that of ASTM Oil No. 3.

SUMMARY OF THE INVENTION

This invention relates to the use of certain fluids having high traction coefficients as lubricants for traction drive transmissions, and to the resulting novel power transmission systems comprising a traction drive transmission and, as a lubricant therefore, said high traction coefficient fluid. The invention also relates to certain novel hydrocarbon base stocks which are useful as lubricants for a traction drive transmission, particularly for the planetary, ring and cone or friction clutch drive types. The base stocks are also useful for lubricants for friction gears, such as a limited slip differential. The base stocks are also useful in lubricants for a Wankel engine (this utility being the invention of Richard J. Stenger and Paul E. Hagstrom, and will be the subject of a later filed patent application).

It has been found that fluid $C_{16}$–$C_{40}$ naphthenes containing a di(cyclohexyl)alkane or a hydrindan as a structural nucleus are especially useful as lubricants for friction (traction) drive transmissions, whether the drive is of fixed or variable ratio.

It was further found that an especially useful power transmission system comprises a fixed ratio, roller traction drive of the type described in the aforementioned AIAA paper of Hewko, or a variable ratio drive of the type shown in the attached drawing and labelled FIGS. 1 and 2, and as a lubricant therefor, a composition comprising a hydrocarbon base stock boiling in the lubricating oil range and having an ultraviolet absorbence at 260 millimicrons (260 UVA) below 0.5, said base stock containing, preferably, at least 10% by weight of a $C_{16}$–$C_{27}$ hydrindan. For example, a transmission system comprising the fixed ratio roller traction drive of the Hewko AIAA paper and, as a lubricant, a hydrocarbon base stock containing 45 volume percent of 1-cyclohexyl 1,3,3-trimethyl hydrindan (hereinafter, sometimes CHTMH), 5 volume percent of 2,4-(dicyclohexyl)-2-methylpentane (hereinafter, sometimes DCHMP), and 50 volume percent of a 5 cs. (at 210°F.) polyisobutylene oil wherein over 33% of the repeating units are of the gem-dimethyl configuration, permits the resulting power transmission system to operate at double the torque throughout of the better of the prior art fluids (naphthenic mineral oils) shown in the Hewko paper.

Additionally, it has been found that fluid $C_{13}$–$C_{40}$ naphthenes containing a spirodecane, spiropentane, perhydrofluorene, perhydrobiphenyl, perhydroterphenyl, decalin, norbornane, perhydroindacene, perhydrohomotetraphthene, perhydroacenaphthene, perhydrophenanthrene, perhydrocrysene, perhydroindane-1-spirocyclohexane, perhydrocarylophyllene, pinane, camphane, perhydrophenylnaphthalene, adamantane or perhydropyrene, as a structural nucleus, are useful as lubricants for traction drive transmissions. Partially saturated precursors of such naphthenes (such as those described in the applications of Haseltine, Jr. and Driscoll filed May 17, 1971 and June 11, 1971) can also be useful as such lubricants, particularly in the blended base stock. One such precursor is 3-cyclohexyl-1,1,3-trimethylindan.

In one novel and very useful embodiment, as is disclosed further hereinafter, certain adamantane hydrocarbons, and fluoro, carboxylic acid, keto, ether or ester derivatives of such adamantanes, are useful as traction fluids or components of traction fluids. In general, good traction properties appear to be a characteristic of compounds containing the adamantane nucleus or of those naphthenes or alkyl or cycloalkyl naphthenes which are capable of being converted to adamantanes by the Schneider reactions of U.S. Pat. No. 3,128,316 or the reactions of U.S. Pat. Nos. 3,275,700, 3,336,405 and 3,336,406. However, for better combination of traction properties, fluidity at 210°F. and low temperature properties, those naphthenes containing the hydrindane, decalin, perhydrophenanthrene, cyclohexyl, perhydroterphenyl, perhydroacenaphthene, adamantane or perhydrophenalene nucleus are a preferred group of perhydroaromatics. Fluorinated derivatives of these perhydroaromatics wherein an average of from 1 to all of the hydrogen of the hydrocarbon is replaced by fluorine are also useful as traction fluids or as components of traction fluids. Such fluoro-derivatives are also useful as refrigerants or as a fluid in a Rankin cycle engine. The fluoro-derivatives can be prepared by the processes in Ser. No. 440,614.

Generally, those naphthenes having the lower viscosity index (particularly below an ASTM-VI of 0—except where the structural nucleus is phenanthrene or adamantane) will have the higher traction coefficients. These naphthenes can be so used per se, or they can be compounded with additives, such as a dispersant or an antioxidant, or with certain hereinafter described paraffin hydrocarbons or hydrogenated lube oils in order to alter the fluid properties of the resulting lubricant (which, depending upon the desired end use, can be as fluid at room temperature as a gas oil or as stiff as a bearing grease).

A preferred embodiment is a power transmission system comprising a traction drive transmission and as a lubricant therefor, a composition comprising a hydrocarbon base stock boiling mainly above 500°F. and having a kinematic viscosity at 210°F. in the range of 1.5–200.0 (preferably 1.8–20) cs., said base stock comprising a perhydrogenated trimer, dimer or codimer of 1. styrene
2. α-methyl styrene,
3. β-methyl styrene, or
4. a mono- or dimethyl ring-substituted derivative of (1), (2), or (3).

To control fluid loss, it is preferred that the base stock boil no lower than in the gas oil range, more preferably the base stock should boil in the lube oil range. Broadly, the oil should boil mainly above 500°F. and, preferably, mainly above 600°F. and (except in greases) have a 90% point below 950°F. Distillation of such stocks is preferably conducted at reduced pressure (as below 5 mm. Hg.) including vacuum-steam distillation, to avoid thermal decomposition. Traction greases can be compounded from such base stocks using conventional additives (e.g., soaps).

However, the soap thickeners (e.g., lithium stearate, sodium palmitate, etc.) used in conventional mineral oil greases are fairly good lubricants. The soap can cause, at least to some degree, a reduction in the high friction built into the traction fluid. Therefore, the preferred traction greases are made from non-soap thickeners. Examples of non-soap thickeners are colloidal silica (e.g., Cab-o-sil), a treated clay (e.g., Baragel); clay (e.g., Montmorillanite with surface activation performed in situ); very fine asbestos and colloidal graphite.

The following Roxana Four Ball Test results show the improvement in traction which is obtained by greases prepared according to this invention, which is the invention of Richard J. Stenger, C. Robert Knott and Arther T. Polishuk and will be the subject of a later-filed application:

| Composition | | Relative Torque Transfer, 4 Ball Test | 60 Stroke PEN |
|---|---|---|---|
| Base Oil - % Thickener | % | | |
| Traction - none | 0.0 | 76.33 | |
| Traction - Al Soap | 3.4 | 78.2 | 285,275 |
| Traction - Baragel | 5.5 | 99.5 | 305 |
| Traction - Silica | 4.7 | 111.5 | 300 |
| Naphthenic Oil - Baragel | 6.0 | 61.5 | 300 |
| Traction - Graphite | 40.0 | | 11 |
| Traction - Asbestos | 30.0 | 92.29 | 305 |

The "Traction" base oil comprised a blend of hydrogenated dimers and trimers, both primarily indan form, of α-methyl styrene and had a $KV_{210}$ of 11.18, $KV_{100}$ of 334.9, and ASTM-VI less than 0. Similar greases can be obtained using the blended base stocks of the present invention and non-soap thickeners.

A grease exhibiting such high traction has application wherever a fluid of high traction would be used but where other considerations make impractical the use of a fluid lubricant. An example is lubrication of the linear actuator, Rollguide, made by the Dumore Company of Racine, Wisconsin. Another example is lubrication of the high speed traction drives used with turbine dental drills; Miniature Precision Bearings of Keene, New Hampshire makes such a traction drive. Another example is in the lubrication of roller clutches, where reduced slip increases service life.

A traction fluid or such a grease prepared from a traction fluid, can be used as a lubricant in a cam, roller drive, clutch or any mechanism where the load is concentrated on a series of joints. With such a traction lubricant, service life of the device is increased by decreasing stresses.

Normally, the monomer-free perhydrogenated reaction products will contain components boiling mainly in the range of 100°–250°C. at 0.5 mm. Hg. and the portion chosen for a particular base stock will be obtained by vacuum distillation to recover a fraction of the desired viscosity and flash point. Preferably, the flash point is above 160°F. and more preferably, above 250°F. The viscosity and/or viscosity index of our oils can also be adjusted by "dumbbell" blending, that is, adding controlled amounts of "light (lower boiling) ends and heavy (higher boiling) ends." However, as will be further disclosed hereinafter, in the case of fluids containing polyolefin oils it is preferred that dumbbell blending be avoided, since it has been found that the better combination of traction coefficient and viscosity index is frequently obtained by choosing a narrow boiling fraction of the desired viscosity, or by blending oils having similar, narrow boiling ranges.

Especially useful components of oils of higher viscosity are the naphthenes corresponding to perhydrogenated trimeric or tetrameric products which are normally present in minor amounts in our perhydrogenated styrene dimerizate but which can be concentrated in the distillation "bottoms" or in fraction boiling mainly above about 615°F. These trimers and tetramers can also be prepared in high yield by further polymerization of the dimerizate prior to perhydrogenation, especially when the dimerizate is polymerized with additional monomer.

The perhydrogenated dimer or codimer can preferably consist mainly of a $C_{16}$–$C_{22}$ cyclohexyl hydrindan or mainly of a $C_{12}$–$C_{29}$ di(cyclohexyl)-alkane and usually will consist of a mixture of isomers of both such structures. The structural formulae of the above-mentioned naphthenes is as follows:

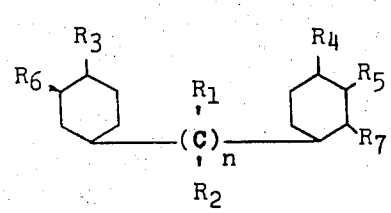

di(cyclohexyl)alkane

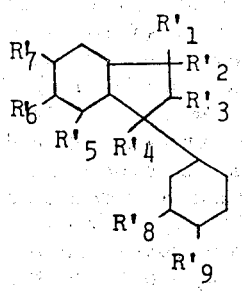

cyclohexyl hydrindan wherein $n$ is 1–3, $R_1$ and $R_2$ are hydrogen or methyl and can be different or the same, $R_3$, $R_4$, $R_5$, $R_6$ and $R_7$ are hydrogen, methyl, ethyl or isopropyl and can be different or the same, $R'_1$ is methyl or ethyl and $R'_2$, $R'_3$, $R'_4$, $R'_5$, $R'_6$, $R'_7$, $R'_8$ and $R'_9$ are hydrogen or methyl and can be different or the same. Such naphthenes are described more fully in copending parent application Ser. No. 679,833, now U.S. Pat. No. 3,595,796.

Such a hydrocarbon base stock having an initial traction coefficient greater than that of ASTM Oil No. 3 at 600 ft./min., 200°F., 400,000 p.s.i. and comprising a blend of naphthenes with a polyolefin and/or hydrogenated petroleum or polyolefin oil can also contain (as in addition to the perhydrogenated dimer, trimer, and tetramer) up to 10 weight percent of aromatic compounds (or naphthene precursors), such as naphthalenes, phenanthrenes, acenaphthenes, indacenes, hydrindacenes, fluorenes, phenyl indanes, phenylhydrindans and phenyl-alkyl cyclohexyl compounds. Occasionally such aromatics can be useful since they aid in dissolving certain additives in the fluid. However, to insure against degradation of the traction coefficient under the severe operation conditions encountered in a friction drive transmission, we prefer that the hydrocarbon base stock contain less than 5% of unsaturates, or more preferred be substantially free from olefinic and aromatic unsaturation as evidenced by an ultraviolet absorbency at 260 millimicrons (260 UVA) of less than 0.5 and an iodine number less than 5.

When the nummerical values reported herein for the traction coefficients of various fluids are compared with the values of other researchers, the values should be adjusted by using the values hereinafter cited for ASTM Oil No. 3 or those for DMAP as the standardization point.

BRIEF DESCRIPTION OF THE DRAWINGS

In the attached drawings

FIGS. 3 and 4 of copending application Ser. No. 679,833, filed Nov. 1, 1967, of Duling and Gates present points representing experimentally determined traction coefficients and viscosity temperature function-viscosity indexes (VTF-VI) of a number of hydrocarbon fluids. The scattering of these points illustrates the unpredictability, based on chemical composition above, of the suitability of a particular fluid as a lubricant for a traction transmission. The points and the curves contained on the figures illustrate the generality that a fluid having a high coefficient of traction tends to have poor low temperature properties. The curves of the two figures also aid in illustrating the discovery that certain fluids have a higher coefficient of traction than other fluids of about the same VTF-VI.

Figure 2:
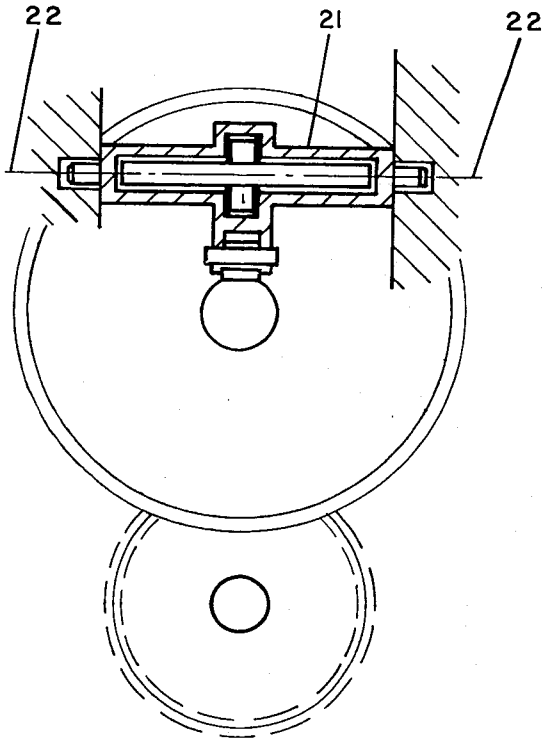
FIGS. 1 and 2 represent, respectively, a side view in cross-section and a partial front view in cross-section of a power transmission system comprising a toric traction drive transmission and a lubricant therefor, containing one of the blended traction fluid base stocks of the present invention.
Figure 1:
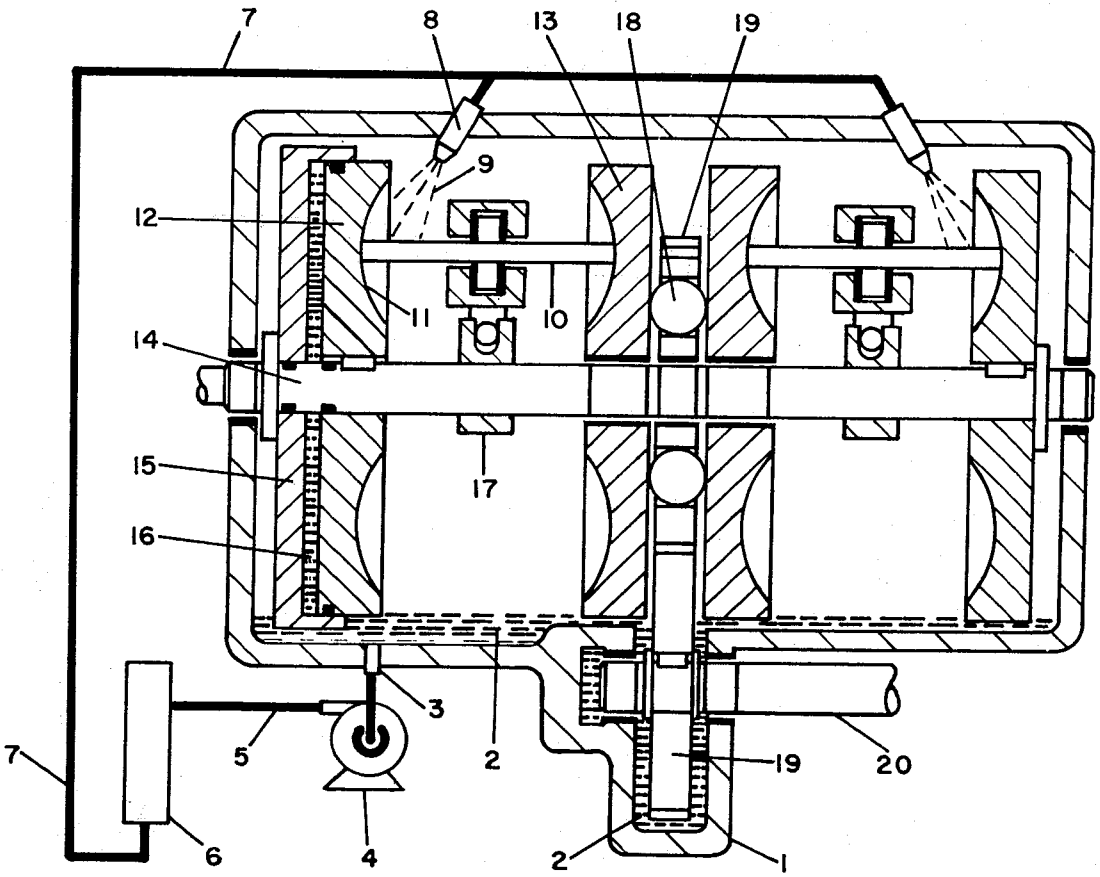

The power transmission system illustrated in FIGS. 1 and 2 is suitable as a continuous automatic variable speed power transmission for automotive use. The toric traction transmission of the figures is similar to that described in Hewko et al., "Tractive Capacity and efficiency of Rolling Contacts", *Proceedings of the Symposium on Rolling Contact Phenomena*, Elsvier, Amsterdam, 1962, pp. 159–161. The power transmission system containing a traction fluid of the present invention comprises a toric drive transmission 1, the traction fluid 2, means, such as a drain 3, a pump 4, and a line 5, to remove said fluid from said transmission and circulate it through a heat exchanger 6 (as an automotive-type radiator), in order that the temperature of the fluid 9 entering the transmission be kept (preferably) below 230°F. (more preferably no higher than 200°F.), and means, such as line 7 and spray nozzle 8, for returning the cooled fluid to the interior of the drive unit.

In operation of the drive unit illustrated in FIGS. 1 and 2, spheroidal steel rollers 10 running on toroidal steel braces 12 and 13 mounted on suitable shafting 14 and 20 are the principal power transmitting components. The toroidal drive in FIGS. 1 and 2 consists of an input race 13, and output race 12, and three rollers, only one of which 10 can be seen in FIG. 1. Rollers of each section are spaced 120° apart and 1/6 of the input torque is transmitted by each roller. Both input races 11 are free to rotate on the output shaft 14 whereas both output races 12 are splined to it. Contact load is applied hydraulically by the piston 15 through a hydraulic fluid 16. The double section arrangement makes the thrust force resulting from the contact load self-contained and eliminates having the ground and thrust through a high capacity thrust bearing. In FIG. 1 the surface of the roller which is in contact with the input face is shown as having the same radius of curvature as that of the face. Such a configuration presents a most difficult lubrication problem. Lubrication is greatly facilitated when the radius of curvature of the contact surface of the roller is less than the radius of curvature of the input face (see U.S. Pat. No. 1,867,553).

The cooled traction fluid 9 which acts as a lubricant and coolant for the drive is supplied through one or more spray nozzels 8 which are preferably directed toward the contact area between the steel roller and the race. Circulation of the lubricant throughout the drive unit is accomplished by splash effect. That is, the bottom section of the casing which houses the differential driver gear 19 acts as a sump for fluid which is circulated to the differential ball bearings 18 as the gear rotates.

A change in ratio is accomplished by tilting all rollers about an axis 22 and thus changing the effective radii of the input including the rollers through some angle about an axis through the race contacts, thus, steering the rollers into the desired ratio position. The ratio between the two sections is kept constant by locking the two synchronizing collars 17 in a position that means the speeds of both input races are identical. The input races are driven through a ball differential 18 by the differential driver gear 19 mounted on the input shaft 20. This arrangement equalizes the torque between the two sections and permits both the input and output shafts to have the same direction of rotation.

It can be seen that an important requirement of a traction fluid for use in such an automotive transmission system is that it not only have good traction properties, but also be a good lubricant for the differential gear and differential ball, and a good lubricant for the rollers and races. Although such a traction fluid could also be used as the hydraulic fluid 16 in the unit, it is preferred that the hydraulic fluid contain an indicator means, such as a distinctive dye, so that leakage of the hydraulic fluid into the main body of the drive unit can be detected by inspection of the main body of traction fluid, such as by a dip-stick arrangement.

To prevent loss of fluid by vaporization and to insure against introduction of contaminants into the fluid, the transmission system should be fully enclosed and well sealed. With the more volatile fluids, the seals and system should be capable of withstanding pressure exerted by the vaporized portion of the fluid at operating temperatures.

FURTHER DESCRIPTION OF THE INVENTION

The perhydrogenated oligomers of styrene, $\alpha$-methyl styrene, $\beta$-methyl styrene and mono- and dimethyl ring-substituted derivatives thereof which are useful in the present invention can be obtained by conventional addition polymerization, as by the dimerization of styrene in aqueous sulfuric acid (see Rosen, M. J., J. Org. Chem. 18, 1701 (1953)), followed by high pressure hydrogenation (at least 1000 p.s.i.g., preferably in the range of 2000–10,000 p.s.i. of $H_2$), as with Raney nickel catalyst at 200°C. and 3000 p.s.i. of hydrogen. They may also be obtained by polymerization of a vinyl cyclohexane or by hydrogenation of the polymerization product of vinyl cyclohexene or of an alkyl substituted vinyl cyclohexene or by the hydrogenation of the product of the copolymerization of a mixture of vinyl cyclohexenes (including alkyl derivatives thereof), such as by the methods shown in U.S. Pat. No. 2,543,092. Also useful is the hydrogenated vinyl cyclohexene dimer of U.S. Pat. No. 2,590,971.

Further description of such perhydrogenated oligomers and processes of their manufacture can be found in U.S. Pat. No. 3,595,796, issued 7-27-71, the disclosure of which has been incorporated herein by reference.

Our hydrocarbon base stock boiling mainly above 500°F. having a viscosity above 3 cs. at 210°F. and containing a $C_{13}$–$C_{40}$ naphthene is useful as a lubricant for a traction drive transmission due to the high traction coefficient and the good stability of such a hydrocarbon base stock when subjected to prolonged use in such a transmission; however, such a power transmission system can be limited to applications wherein temperatures lower than about 0°F. are not encountered, such as in submarines or in naval vessels, or for industrial transmissions which are kept in buildings where the temperature is maintained above about 0°F., and preferably above about 40°F. Such a lubricant can, of course, be used in a transmission which will be exposed to temperatures below 0°F., if the oil is maintained at a higher temperature (as by a heater).

For low temperature use where extremely high fluid pressures are encountered (as in pressure-equalized external submarine transmissions) a fluid of less than 2 cs. at 210°F. and having somewhat lower traction coefficient can be useful. Examples of such low viscosity fluids are Oils, U, Z, AC, and AD in Table III.

For automatic variable speed traction drive automotive transmissions, where weight, cost and simplicity of assembly assume high importance and where temperatures as low as −40°C. can be encountered, it is preferred that the lubricant used for the automotive transmission have a viscosity of no greater than about 7000 cs. at −20°F. and have a pour point no higher than about −40°F. Therefore, such a fluid must have a high viscosity index (preferably above 40 VTF-VI and more preferably above 75) and have a viscosity at 210°F. in the range of 3–15 cs.

As the viscosity index of an oil increases, its traction coefficient generally decreases. This relationship is particularly striking when the traction coefficient and the VTF-VI of hydrogenated poly-1,3(3-methylbutene-1), Oil 31, is compared with hydrogenated poly(1-octene), Oil 46.

For an explanation of the viscosity-temperature function (VTF) and the desirability of using the VTF in the determination of the viscosity index of an oil (e.g., the VTF-VI), see Wright, W. A., *ASTM Bull.* No. 215, July, 1956, pp. 84–86 (TP 140–142) and Stearns, R. S., et al., *ICEC Product R J D*, Vol. 5, Dec., 1966, pp. 306–313.

Paraffin oils possessing a high proportion of repeating units having the structural formula

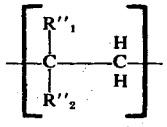

wherein $R''_1$ is hydrogen or methyl and wherein $R''_2$ is hydrogen, $R''_2$ is i-propyl or i-butyl and when $R''_1$ is methyl, $R''_2$ is methyl, ethyl, isopropyl or isobutyl, have a higher traction coefficient for a given viscosity index than do the other paraffin oils.

Such oils and processes for their preparation are found, for example, in U.S. Pat. No. 3,595,796, issued 7-27-71.

For example, it has been found that oils having a good coefficient of traction and a good viscosity index can be obtained by blending at least one naphthene with at least one branched paraffin oil (such as perhydrogenated polyisobutylene) containing a high proportion of repeating units of the aforementioned structural formula.

When such a paraffin is obtained by partial hydrogenation of a polyolefin (as in Ser. No. 052,301) the blend can contain large amounts of the corresponding olefin. Table I of U.S. Pat. No. 3,595,796 lists the primary structural units found in a large number of oils, and/or indicates one means of preparing each such oil. Table II of U.S. Pat. No. 3,595,796 lists certain properties of the test oils including their traction coefficient at various conditions when tested by the method of the aforementioned *J. CIE Data* article by F. G. Rounds. In these traction tests, each oil contained 1% DBPC (dibutyl paracresol) as an antioxidant.

Synthetic liquid $C_3$–$C_8$ olefin polymer, copolymer or terpolymer oils which can be hydrogenated to produce a branched paraffin fluid useful as a component for blending with our naphthene hydrocarbons in order to produce an improved hydrocarbon base for lubrication of traction drive transmissions can be obtained in the manner shown in the following patents and publication: U.S. Pat. Nos. 3,156,736; 2,993,942; 2,360,446; 2,327,705; 3,007,452; 3,090,822; 2,965,691; 2,224,349; 3,100,808; 1,395,620; 2,500,166; Belgian Pat. Nos. 663,550; 663,549, *Industrial and Engineering Chemistry*, Vol. 23, No. 6, pp. 606–607. Note that U.S. Pat. Nos. 1,395,620 and 2,500,166 teach that, under some polymerization conditions, butenes can be converted to naphthenes. Regarding decalins, see U.S. Pat. No. 2,203,102.

We prefer, in our blends, that the branched paraffin component have a relatively narrow boiling point (that is, be of fairly uniform molecular weight); we also prefer those oils which have been obtained by hydrogenation of an olefin polymer obtained from Ziegler catalysis (or by thermal cracking of a highly polymerized olefin). Acid catalyzed polymers are our second choice and, as a third choice, free-radical catalyzed polymers. In general, one preferred branched paraffin component is obtained by polymerization of an olefin, such as isobutylene, as with a Ziegler catalyst to form a fairly high molecular weight polymer which is highly viscous, or even a gel, at room temperature. This fairly high polymer is thermally cracked to obtain an oil of the desired viscosity, which is then fully hydrogenated to produce a branched paraffin oil having, in the case of isobutylene, a high degree of geminal disubstitution or "gem branching." Although an equivalent oil can be prepared by polymerization distillation and hydrogenation, a much more uniform product, inasmuch as 33% higher yield, can be obtained by the process involving polymerizing to a higher degree than is ultimately desired and then thermally cracking (especially at reduced pressure) to obtain an oil of the desired viscosity and natural boiling range. Ziegler catalyzed olefin polymerization is shown in U.S. Pat. No. 2,965,691. As an alternative to thermal cracking followed by severe hydrogenation, suitable branched paraffin oils can be obtained by hydrocracking a viscous olefin polymer, as by the process of U.S. Pat. No. 3,084,205.

In the usual polymerization of isobutylene or mixed olefin streams containing isobutylene, butene-1, and butene-2, the polymerization is conducted in an inert solvent using an acid catalyst such as $AlCl_3$ or $BF_3$. The molecular weight of the product is controlled by adjusting the reaction temperature. A high polymerization temperature (20°–60°C.) produces polymers having a molecular weight (200–1000) in the lubricating oil range. Polymerization at 0°–60°C. yields high polymers of 10,000–1,000,000 molecular weight. Nuclear magnetic resonance spectra and other structural analyses have proven that the high molecular weight polymers are composed of regular repeating isobutylene units connected in a head to tail fashion. That is, the high molecular weight products have a high degree of gem dimethyl repeating units.

However, in the production of oils by high temperature acid polymerization, many side reactions occur which produce branching and even cyclization in the polymer chain. The NMR spectra of such isobutylene oils, having average molecular weights in the range of about 200–1000, will show extra absorption peaks which cannot be produced from the regular, gem dimethyl isobutylene structure. The viscosity index of such high temperature, acid-polymerized polyisobutylene oils is generally about 60 and can be as high as 80. Upon vacuum distillation, narrow boiling fractions of these oils will show lower VIs than the whole oil, that is VIs of −20 to +40.

Although such oils can be used in our traction fluids, we prefer oils which have a higher degree of gem dimethyl branching such as the polyisobutylene oil prepared by the thermal cracking and subsequent hydrogenation of a high molecular weight, low temperature polymerized polyisobutylene which possesses the regular repeating isobutylene structure, or the hydrogenated oil of Ser. No. 052,301. The oils prepared by such thermal cracking or by the process of Ser. No. 052,301 have different NMR spectra and narrow boiling fractions separated from such oils can posses VIs of 90–110 and greater.

One embodiment of the invention comprises a traction drive transmission and, as a lubricant therefor, a composition comprising a hydrocarbon base stock having a kinematic viscosity at 210°F. in the range of 1.5–200.0 cs., said base stock comprising a fully saturated isobutylene oil having a molecular weight of 200–1000, a pour point less than 0°F., an ASTM-VI greater than 90, which contains no distillate fractions having a VI less than 80 and which, by NMR spectra, has from 60–100% of regular repeating isobutylene units having gem dimethyl structure. In such an oil, the NMR spectrum shows a large peak at about 8.58 tau.

Such thermal cracking or hydrocracking of a regular, high polymer can lead to different oils from those polymerized directly from the monomer. For example, the terminal groups of many of the molecules of the cracked polyolefin oils are different from the usual terminal groups found in olefin oils. Also, as in the case of polyisobutylene, if the high polymer has a high degree of regularity, as with solid isobutylene polymers, the resulting cracked oil will show a greater degree of regularity, particularly as to the positioning of the alkyl branches, than will the usual oil obtained by acid polymerization.

Polyolefin oils of Ser. No. 052,301 or those produced by the thermal degradation, at reduced pressure, of highly polymerized, regular isobutylene (that is, polyisobutylene showing a high degree of methylene crowding as evidenced by the peak at 8.58 tau) can be hydrogenated to produce novel synthetic branched paraffin oils which are especially useful as components of traction fluids. The unexpected, valuable character of the novel polybutane oils can be seen by comparing the properties reported for Oil D with those reported for Oil P in the accompanying Table III. Oil D is a blend of 30% of a perhydrogenated dimerizate of α-methyl styrene and 70% of Oil 34 (a highly regular dimerizate of α-methyl styrene and 70% of Oil 34 (a highly regular polyisobutylene obtained by thermal cracking); whereas, Oil P contains 30% of the same hydimer oil and 70% of Oil S, which is an oil similar to Oil 19 (that is, an oil obtained by hydrogenation of an oil obtained directly by the acid polymerization of a mixed butylene stream). Oil D, which contains the novel, regular hydrogenated polyisobutylene oil has an average traction coefficient at 1000 ft./min. which is nearly 18% greater than that of Oil P, which contains the hydrogenated, mixed polyisobutylene.

The NMR spectrum of Oil 34 differs greatly from that of Oil 19 (or Oil S). That is, Oil 34, the hydrogenated, polyisobutylene obtained by cracking, shows a large NMR peak at about 8.58 tau, and almost no NMR peak at 8.84–8.85 tau. As is reported by Bartz and Chamberlain in *Analytical Chemistry*, 36, No. 11, 2151–2158 (1964), a peak at about 8.58 tau indicates maximum methylene crowding and a peak at 8.84–8.85 tau indicates uncrowded methylene groups associated with a branched chain. In gel or solid polyisobutylene, the high degree of methylene crowding is due to a highly regular polymer having a large number of the repeating polymeric units in the internal geminal methyl form.

In Table III, Oil J is a novel oil prepared by blending hydrogenated polyisobutylene oil (Oil 34) showing a large peak at 8.58 tau and nearly no peak at 8.84–8.85 tau with Oil S, prepared by hydrogenation of an oil produced directly by acid polymerization of a mixed butylene stream, and showing little or no peak at 8.58 tau and a large peak at 8.84–8.85 tau. Such novel blended oils are especially useful when blended with a hydrogenated petroleum oil or with a $C_{13}$–$C_{40}$ naphthene.

The polymerization of isobutylene or a mixed olefin stream containing isobutylene in an inert solvent using a Lewis acid catalyst at 20°–60°C. also produces polymer oils having a lower VTF-VI than that of an oil of similar viscosity at 210°F. prepared by the process of cracking or hydrocracking a polymer of at least 2000, and preferably above 15,000 molecular weight. For example, compare the viscosity index of Oil 19 in Table II (which is a typical polybutene prepared in this manner) with the VI of Oil 34, which is a polyisobutylene prepared by our cracking process.

When Oil 19 is distilled, the distillation range is relatively broad (470° to 1050+°F.) and considerable quantities of higher boiling (10% over 1040+°F.) and lower boiling fractions are obtained. The VIs of the individual distillate fractions are considerably lower than the VI of the whole oil. This indicates that the viscosity index of Oil 19 is the result of the well-known process of dumbbell blending.

Even after hydrogenation, such a wide boiling, mixed polybutylene oil, having a low degree of gem branching, and a VI obtained by dumbbell blending, is not as suitable as a component of a blended paraffin-naphthene traction fluid as is the hydrogenated, cracked polyisobutylene. In our blends of naphthene and branched paraffin hydrocarbons, we prefer that each component and particularly the branched paraffin, be of as narrow a boiling range as is economically or technically feasible.

Another highly regular branched paraffin, useful as a traction fluid or in our blends, can be prepared by hydrogenation of an isobutylene polymer prepared by polymerization of 98–100% isobutylene by the method of U.S. Pat. No. 3,242,158. The average molecular weight of the polymer can be controlled by controlling the polymerization temperature, or a high molecular weight product can be thermally cracked to obtain a lower molecular weight polymer. Another useful polymerization process is that of U.S. Pat. No. 3,166,546.

In order to prepare the paraffin oil having such a high degree of gem dimethyl branching by the thermal cracking of a high molecular weight polyisobutylene, followed by hydrogenation, we prefer that the isobutylene polymer have a Staudinger molecular weight ranging from about 15,000 to about 27,000 (that is, be in the heavy, plastic, sticky semi-solid state); however, oils may also be prepared by the thermal degradation of more highly polymerized butylene or of lower molecular weight polyisobutylene oils, ranging from about 1000–15,000 molecular weight.

Polypropylene fluids which, upon hydrogenation, can be useful as components of our traction fluids, can be prepared by the acid polymerization of propylene. We prefer, however, to use a more linear and stable polypropylene fluid prepared by means of a Ziegler catalyst. Such oils should be dewaxed, either before or after hydrogenation, in order to remove the stereoregular polypropylene fraction.

Other oils which are useful as traction fluids or as components of tractions fluids (particularly as a third component of our perhymer-branched paraffin blends) are obtained by perhydrogenation of the mixtures of as-hydrindacenes and indanyl phenyl alkanes which are obtained when indans are contacted with HF and $BF_3$ in liquid phase at 10°–110°C. For example, as is shown in U.S. Ser. No. 388,693 of Ronald D. Bushick, filed Aug. 10, 1964, indan can be contacted with HF and $BF_3$ to produce benzene, as-hydrindacene and 1-(2-indanyl)-3-phenylpropane. Preferably, the lower boiling components (e.g., benzene and unreacted indan) are removed, as by distillation, prior to perhydrogenation. Similarly, a useful component of a blended traction fluid is obtained by perhydrogenation of the reaction mixtures obtained by contacting octahydroanthracene or octahydrophenanthrene in the presence of an acid catalyst, such as $HF.BF_3$ or a crystalline zeolite catalyst, as in U.S. Pat. No. 3,396,203 of Ronald D. Bushick, issued Aug. 6, 1968.

Also useful as a third component of the naphthene-branched paraffin fluids is from 5–50% of a perhydrogenated poly-1-octene oil having a VTF-VI above 80, preferably above 100.

It is sometimes advantageous to insure that the base stock is free from surface active constituents which can reduce the traction coefficient of the lubricant. One useful method of removing such surface active constituents is that of U.S. Pat. No. 2,897,144, which comprises foaming the oil (or a portion thereof) with a non-reactive gas and separating the resulting foam from the bulk of the oil.

Another embodiment comprises a traction drive transmission and as a lubricant therefor, a composition comprising a hydrocarbon base stock having a kinematic viscosity at 210°F. in the range of 1.5–200.0 cs., said base stock comprising a $C_{12}$–$C_{30}$ decalin containing as substituents at least 1 member selected from the group consisting of $C_1$–$C_5$ alkyl, $C_5$–$C_6$ cycloalkyl, and $C_6$–$C_{10}$ alkylcyclohexyl and alkylcyclopentyl. For example, any of the alkylnaphthalenes of U.S. Pat. No. 2,549,377 or U.S. Pat. No. 2,626,242 (including hydrocarbon base fluids which contain such alkylnaphthalenes) can be converted to an alkyldecalin fluid by severe hydrogenation (at hydrogen pressures greater than 1000 p.s.i., preferably greater than 1500 p.s.i. and more preferably from 3000–10,000 p.s.i.).

The resulting decalin fluid can contain up to 10% of residual aromatics (by gel) but, preferably, should contain less than 1% of gel aromatics based on the decalin and have a 260 UVA less than 0.1. Such traction fluids containing decalins have a better combination of fluid properties and traction properties and have a longer effective life when used in a traction transmission than do the alkylnaphthalene fluids of the aforementioned patents. One such decalin is tetraisopropyldecalin (hereinafter sometimes TIPD) the properties of which are reported in Tables I, II, and III herein (see Oils 17, 11, 21, G, and AA).

A novel and preferred type of such a hydrocarbon base stock, useful as a lubricant when contained in a traction drive transmission, has a VTF-VI greater than 40 and a traction coefficient greater than that of DMAP at 600 ft./min., 400,000 p.s.i. at 200°F., and comprises such a decalin having a glass transition below −30°C. and from 0.1–20 parts by weight, based on the total naphthene content of said base stock, of at least 1 fully hydrogenated, synthetic liquid $C_3$–$C_8$ olefin polymer, copolymer, or terpolymer.

An especially useful hydrocarbon base for a traction fluid can be obtained by severe hydrogenation of a refinery stream containing a high percentage of alkylnaphthalenes. Examples of such an alkylnaphthalene-containing refinery stream (and means of concentrating selected fractions) are shown in the following U.S. Pat. Nos.

| | |
|---|---|
| 3,055,956 | 3,270,074 |
| 3,083,244 | 3,277,199 |
| 3,109,039 | 3,336,411 |
| 3,172,919 | 3,340,316 |

Preferably, the 2,7-dimethylnaphthalene (2,7-DMN) and/or 2,6-dimethylnaphthalene, (2,6-DMN) are at least partially removed from the streams (as by crystallization or adsorption on molecular sieve zeolites) prior to hydrogenation of the streams.

Higher boiling, and more viscous, fluids can be obtained from the higher boiling hydrocarbon streams or from such dimethylnaphthalene-containing streams by alkylation of the dimethylnaphthalene stream with a $C_2$–$C_5$ monoolefin (as with $HF.BF_3$ catalyst) prior to hydrogenation. An especially useful hydrocarbon stream for such an alkylation is one containing a high proportion of 2,4-DMN. Residual aromatics can be removed from a hydrogenated refinery stream containing decalins by means of an adsorbent such as a molecular sieve zeolite or silica gel.

In another embodiment, it was discovered that both the traction properties and fluid properties of the conventional petroleum oils which normally contain from 15–60% gel aromatics or of the usual hydrotreated and/or acid treated and/or solvent treated naphthenic oils (which can contain as little as 5% gel aromatics) can be improved by severe hydrorefining so as to minimize or eliminate the presence of aromatic hydrocarbons in said oils. This embodiment is contrary to the teachings in the art which indicate that hydrogenation has little or no effect on the traction properties of naphthenic oils. For example, see Rounds, F. G., *J. CJE Data*, Vol. 5, No. 4, page 507, wherein it is stated, "Limited attempts to change the friction properties of a naphthenic lube by fractionation and hydrogenation were unsuccessful".

The factor which has not been heretofore appreciated by the art is that although the usual hydrotreating has little or no effect on the traction properties of a naphthenic oil, however, if the hydrogenation is so severe as to virtually eliminate the presence of aromatic hydrocarbons in the resulting hydrogenated oil, the traction properties will be significantly improved (perhaps due to the type of naphthene to which the aromatics are converted). This discovery is illustrated in Tables I, II, and III of U.S. Pat. No. 3,595,796, by comparing Oils 12, 18, 22, 24, 27, 30, 33, 35, 36, 50, 51, I, and AB.

It was also found, for example, compare Oil 23 with Oil 19, that hydrogenation (to an iodine number less than 2) of a polybutene oil will improve the average traction coefficient somewhat.

For example, Oil 36 is a naphthenic distillate, obtained by the process of U.S. Pat. No. 3,184,396, which is hydrorefined, using sulfided nickel molybdenum oxides on alumina catalyst, at 1000 p.s.i. of hydrogen, a fresh feed LHSV (liquid hourly space velocity) of 0.5 and a recycle LHSV of 3.5 at 650°F. Severe hydrogenation of the hydrorefined oil produces Oil 27, having a much higher VI and a significantly improved traction coefficient. This severe hydrogenation can be conducted at 3000 p.s.i. of hydrogen, in a bomb, for 6 hours using Raney nickel catalyst (although platinum on alumina gives similar results), followed by adsorption on silica gel to remove residual aromatics (about 1%).

The following table, Table V, illustrates the improvement in traction coefficient and fluid properties imparted by this severe hydrogenation.

TABLE V

| Oil No. | 260 UVA | Traction Coefficient* | $KV_{210}$cs | VI ASTM | VI VTF | Pour Point |
|---|---|---|---|---|---|---|
| 27 | 0.000 | 0.043 | 4.56 | 26 | 45 | −40 |
| 36 | 0.5 | 0.038 | 4.64 | 2 | 10 | −25 |

*1000 ft./min., 5000,000 p.s.i., 200°F. by method of Rounds, Ibid.

Similarly, at 600ft./min., 400,000 p.s.i., 200°F., the traction coefficient of Oil 36 is 0.039 and Oil 27 0.048. We prefer that the severely hydrogenated naphthenic oils, when used as a traction fluid or a component of a traction fluid, contain less than 1% of aromatic hydrocarbons (by gel).

One embodiment is a traction drive transmission containing as a lubricant, the composition comprising a hydrocarbon base stock having a kinematic viscosity at 210°F. in the range of 1.5–200.0 cs., said base stock comprising a naphthenic oil containing less than 1% of aromatic hydrocarbons. Preferably, the naphthenic oil should have an ultraviolet absorptivity at 260 millimicrons (260 UVA) of less than 0.05, and more preferably less than 0.005. Typically, such hydrogenated naphthenic oils can have a viscosity of 100°F. of as low as 30 SUS to as much as 10,000 SUS.

Another embodiment comprises a traction drive transmission containing such a fully hydrogenated or saturated naphthenic oil and from 0.1 to 10 parts by weight, based on the naphthenic oil, of at least 1 fully hydrogenated, synthetic liquid $C_3$–$C_8$ olefin polymer, copolymer, or terpolymer. We prefer that the hydrogenated liquid polymeric olefin comprise at least 33% gem dimethyl branching, such as is found in the polybutylene oils. Even more preferable is a polyisobutylene oil having at least 90%, and preferably 100% of gem dimethyl branching (exclusive of end groups).

A comparison of the properties reported in Tables II and III for Oil 35 (ASTM Oil No. 3, a naphthenic lube) and Oil 30, which is prepared by severe hydrogenation of Oil 35 followed by removal of residual aromatics by adsorption of silica gel, shows that the viscosity index of the resulting severely hydrogenated oil is much higher and that the average coefficient of traction is also significantly increased. Also note that the severely hydrogenated naphthenic distillate, Oil 27, has a significantly increased coefficient of traction (especially see data at 600 ft./min., 400,000 p.s.i. and 200°F.) — see also Oil 22. A major difference in comparison between the naphthenic lube, 35, and the naphthenic distillate used to prepare Oil 22, is that the naphthenic distillate contains 45% of aromatic hydrocarbons prior to hydrorefining (and had 21% of aromatic carbon atoms, i.e., $C_A$). The amount of residual aromatics removed from the severely hydrogenated distillate by silica gel is very small (less than 1%); therefore, the resulting completely hydrogenated naphthenic distillate contains more than twice the weight of naphthenes (a total of about 70% naphthenic carbon atoms) than is found in the usual hydrorefined naphthenic oil.

In the severely hydrorefined naphthenic oils, at least 15% (preferably over 25%) by weight of the naphthenes contained herein will result from perhydrogenation of the aromatics contained in the oil prior to hydrogenation. Note that Oil 35, a naphthenic lube, contains 43% aromatic hydrocarbons and has a 37% $C_N$ and 20% $C_A$; the severely hydrogenated product, Oil 30, has a high content of naphthenes corresponding to the perhydrogenated products of these highly condensed aromatic hydrocarbons present in the oil before hydrogenation.

In another embodiment a saturated naphthenic traction fluid is prepared by severe hydrogenation (to less than 1% gel aromatics) of a naphthenic distillate (or an acid refined or solvent refined naphthenic oil) or a hydrorefined naphthenic distillate, containing at least 10% gel aromatic hydrocarbons and having a kinetic viscosity at 210°F. less than 3.0, and preferably less than 2.5 cs. Such fluids are especially useful, due to their low initial viscosity, as traction fluids in external submarine drives. For example, in Table II of U.S. Pat. No. 3,595,796. Oil 50 is obtained by severe hydrorefining of a 50 SUS (at 100°F.) naphthenic distillate containing 40% aromatics, and having a 260 UVA of 5.4.

Such a severely hydrogenated light naphthenic distillate can also be blended with perhydrogenated oligomer oils (such as the perhydrogenated hydrindantrimer of $\alpha$-methyl styrene), as is illustrated by Oil 51 in Table II of U.S. Pat. No. 3,595,796. The severely hydrogenated naphthenic oils can be distinguished from the naphthenic oils of Rounds in *J. CJE Data*, Ibid., in that the oils contain more than 50%, and preferably more than 75% of naphthenic hydrocarbons (by the method of vanNes and vanWesten) and contain less than 2% of aromatic hydrocarbons.

In another embodiment of the invention the severely hydrogenated naphthenic oil (having a viscosity in the range of 30–10,000 SUS at 100°F.), containing more than 50% of naphthenic hydrocarbons and less than 1% of aromatic hydrocarbons, is blended with from 0.1–10 parts by weight, based on the perhydrogenated naphthenic oil, of at least 1 fully hydrogenated, synthetic liquid polymer, copolymer, or terpolymer of $C_4$–$C_7$ olefin. We especially prefer that the branched paraffin oil be a polyisobutylene having a high proportion of its structural repeating units of the gem dimethyl branching, according to the structural formula

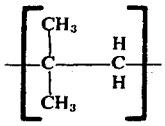

Such an oil will, preferably, have a large NMR peak at about 8.58 tau.

Another embodiment of the invention relates to novel blended fluids and utilizes the discovery that the traction properties of branched paraffin oils containing a low degree of gem dimethyl branching (as evidenced by a large NMR peak at about 8.58 tau). Such blended oils can advantageously be blended with from 0.1–10 parts by weight of severely hydrogenated naphthenic distillates, in the formulation of a traction fluid.

Other embodiments of the invention involve the discovery that fluid $C_{18}$–$C_{40}$ naphthenes containing a perhydroterphenyl, or fluid $C_{13}$–$C_{25}$ naphthenes containing perhydrofluorene as a structural nucleus, are useful as lubricants for traction drive transmissions, whether the drive is of a fixed or variable ratio.

The perhydrogenated terphenyl and fluorene compounds which are useful in the present invention can be obtained by conventional synthesis as by the hydrogenation of terphenyls, fluorene or substituted fluorenes or terphenyls, or partially hydrogenated derivatives thereof, as with Raney nickel catalyst at 200°C. and 3000 p.s.i. of hydrogen. The substituted fluorene derivative can be in relatively pure form, or can be present in concentrations as low as 10% in distillate fractions from petroleum refining or petrochemical manufacture.

One embodiment is an especially useful power transmission system comprising a fixed ratio, roller traction drive of the type described in the aforementioned AIAA paper of Hewko, or a variable ratio drive of the type shown in the attached drawings labelled FIGS. 1 and 2, and as a lubricant therefor, a composition comprising a hydrocarbon base stock boiling in the lubricating oil range, having a viscosity at 210°F. in the range of 2.0–12.0 cs., and having an ultraviolet absorbance at 260 mM (260 UVA) below 0.5 preferably at least 10 percent, by weight of a $C_{18}$–$C_{26}$ perhydroterphenyl to a $C_{13}$–$C_{25}$ perhydrofluorene. For example, a transmission comprising the fixed ratio roller traction drive of the Hewko AIAA paper, and as a lubricant, a hydrocarbon base stock containing 10 volume percent of perhydrofluorene and 90 volume percent of a 5 cs. (at 210°F.) polyisobutylene oil wherein over 33 percent of the repeating units are of the gem-dimethyl configuration, permits the resulting power transmission system to operate at a higher torque throughout than with the better of the naphthenic mineral oils shown in FIG. 3, at page 4, of the Hewko paper.

A preferred embodiment of our invention is a power transmission system comprising a friction drive transmission, and as a lubricant therefor, a composition comprising a hydrocarbon base stock boiling mainly above 500°F. and having a kinematic viscosity at 210°F. in the range of 1.5–200.0 (preferably 1.8–20) cs., said base stock comprising perhydrogenated orthoterphenyl or perhydrofluorene or a saturated, $C_{19}$–$C_{40}$ hydrocarbon substituted derivative of terphenyl or a hydrocarbon substituted derivative of perhydrogenated fluorene wherein said hydrocarbon substituent is selected from the group consisting of alkyl, cycloalkyl and alkylcycloalkyl.

Perhydrofluorene (having an ASTM-VI of 105, a $KV_{210}$ of 2.5 cs. and a pour point less than 0°C.) and $C_{17}$–$C_{23}$ alkyl substituted derivatives thereof (e.g., the dimethyl derivatives) are also useful as components of traction fluids, as are perhydroacenaphthalenes. Preferred perhydrogenated acenaphthalene and fluorene derivatives can be obtained by perhydrogenation of the following fluorene compounds (or hydro- derivatives thereof):

1-(5-acenaphthyl)-butane
1-(5-acenaphthyl)-hexane
9-methylfluorene
9-(4-methyl-benzylidene)-fluorene
9-phenyl-fluorene
1,8-dimethyl-9-(2-tolyl)-fluorene
9-benzylidene-fluorene Preferred perhydrogenated terphenyl derivatives can be obtained by perhydrogenation of orthoterphenyl (or hydro-o-terphenyls) or $C_{19}$–$C_{24}$ methyl substituted-o-terphenyls or by hydrogenation of hydrocarbon streams containing at least 5% of o-terphenyl.

To control fluid loss, it is preferred that the base stock boil no lower than in the gas oil range, more preferably the base stock should boil in the lube oil range. Where the base stock boils mainly below the gas oil range, the fabrication of a transmission utilizing such a stock as a lubricant becomes costly because tolerances become critical and the seals must be very tight in order that there is no undue loss of the fluid through vaporization. Such highly volatile fluids, however, can be quite useful as lubricants when the transmission is properly designed so as to prevent fluid loss by vaporization and when the pressure-volume-temperature relationship within the transmission is such that a substantial portion of the fluid remains in liquid phase during the operation of the transmission.

Broadly, the oil should boil mainly above 500°F. and, preferably, mainly above 600°F. and (except in greases) have a 90% point below 950°F. Distillation of such stock is preferably conducted at reduced pressure, including vacuum-steam distillation, (as under 5 mm. Hg.) to avoid thermal decomposition.

Normally, our monomer-free perhydrogenated terphenyl and fluorene compounds will be produced from distillate fractions obtainable in a petroleum refinery, such as the recycle from catalytic cracking or the recycle from thermal demethylation of alkyl aromatic hydrocarbons. Satisfactory traction fluids can be compounded from such perhydrogenated distillate fractions, when the distillate fraction contains at least 5% (preferably at least 15%) of terphenyl, fluorene, hydrofluorene, or hydroterphenyl compounds.

The hydrocarbon base stock of our invention can also contain naphthenes corresponding to perhydrogenated terphenyl or fluorene or alkyl and cycloalkyl derivatives thereof, the base stock has a low viscosity index, and therefore, has poor low temperature properties, such as the pour point. We have discovered that novel traction fluids having a traction coefficient at least 10% greater than that of DMAP (at 600 ft./min., 200°F., 400,000 p.s.i.) and having an ASTM-VI greater than 40, can be prepared by blending from 1–20 parts by weight of fluid, branched paraffin hydrocarbons containing an average of over 3 branches per chain, with fluid $C_{18}$–$C_{40}$ naphthenes containing perhydroterphenyl or perhydrofluorene as a structural nucleus and with a hydrogenated paraffinic lube and/or an adamantane compound.

We have discovered, surprisingly, that a particularly useful power transmission system comprises a friction drive transmission and, as a lubricant therefor, a substantially saturated hydrocarbon base stock having a 260 UVA below 0.5 and comprising at least one member selected from the class consisting of perhydro-ortho terphenyl, $C_{18}$–$C_{40}$ hydrocarbon substituted derivatives of terphenyls, perhydrofluorene and the $C_{14}$–$C_{25}$ hydrocarbon substituted derivatives of perhydrofluorene, the perhydroterphenyl or perhydrofluorene compound being present in an amount of at least 5% by weight of the base stock, and wherein there is present from 0.1–20 parts by weight based on said perhydrofluorene, of a fully hydrogenated, liquid $C_3$, $C_4$, $C_5$, $C_6$, $C_7$, or $C_8$ olefin polymer, copolymer, or terpolymer. Preferably said olefin comprises isobutylene, 3-methylbutene-1, 4-methylpentane-1, or 2,3-dimethylbutene-1. More preferably at least 35% (most preferably 90–100%) of the repeating units (exclusive of terminal methyl groups) of said olefin polymer have the structure

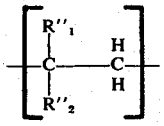

wherein $R''_1$ is hydrogen or methyl, and when $R''_1$ is hydrogen, $R''_2$ is isopropyl or isobutyl, and when $R''_1$ is methyl, $R''_2$ is methyl, ethyl, isopropyl, or isobutyl.

Ser. No. 679,851 discloses a power transmission system comprising a traction drive transmission and, as a lubricant therefor, a hydrocarbon base stock having a kinematic viscosity at 210°F. in the range of 1.5–200.0 cs., said base stock comprising a paraffinic oil containing less than 1% by weight of aromatics having an ultraviolet absorptivity at 260 millimicrons of less than 0.5. Preferably, the paraffinic oil is obtained by severe hydrogenation of a petroleum oil having a percent $C_P$ greater than 60, a percent $C_N$ greater than 30, and a percent $C_A$ greater than 2. The paraffinic oil, preferably, has an ASTM-VI greater than 80, a refractive index at 68°F. greater than 1.47 and an SUS viscosity at 100°F. in the range of 60–3000.

In another embodiment, the base stock contains from 5–75% of a $C_{13}$–$C_{40}$ naphthene having a glass transition temperature in the range of −90° to −30°C. and containing, as a structural nucleus, a cyclohexyl hydrindan, di(cyclohexyl)-alkane, spirodecane, spiropentane, perhydrofluorene, perhydrobiphenyl, perhydroterphenyl, decalin, norbornane, perhydroindacene, perhydrohomotetraphthene, perhydroacenaphthene, perhydrophenanthrene, perhydrocrysene, perhydroindane-1-spirocyclohexane, perhydrocarylophyllene, pinane, camphane, perhydrophenylnaphthalene, perhydropyrene, or adamantane. Although the conventional paraffinic and naphthenic petroleum oils contain minor amounts of individual members of some or all of the above types of naphthene, it is very rare to encounter more than 5% of any individual class in a given petroleum lubricating oil. Therefore, a given paraffinic oil, of the type useful in our invention, should be analyzed to determine its content of some or all of the aforementioned classes of naphthene and, at least one member of at least one of the above classes of naphthene should be added to the paraffinic oil in sufficient quantity to increase the traction coefficient thereof. Preferably the traction coefficient at 600 ft./min., 400,000 p.s.i., 200°F., should be increased at least 10% by means of such addition of naphthenes.

Another useful component of a blended traction fluid is a $C_{12}$–$C_{48}$ adamantane compound containing no elements other than carbon, hydrogen, fluorine and oxygen and wherein if oxygen is present, said oxygen is in a hydroxyl, ketone, or carboxylic acid radical or is combined in an ether or an ester linkage. Such compounds are generally known to the art or are described in the previously cited application Ser. Nos. 679,801; 876,993; 003,256; 056,680; 080,779; 091,183 and the application of Driscoll and Haseltine, Jr., filed May 17, 1971 and June 11, 1971. A preferred base stock comprises such an adamantane compound and a partially or fully hydrogenated polyolefin oil (especially a polyvinylidene, such as polyisobutylene, having a high degree of gem substitution as in the previously cited application Ser. Nos. 028,942; 052,300; 052,301; 052,771; 052,772; 052,773; 052,268 and the applications of Driscoll and Haseltine, Jr.).

In general, the traction coefficient of any hydrocarbon oil, whether synthetic or a refined mineral oil, can be improved by addition thereto to an effective amount (typically 0.5–25 weight percent) of such an adamantane compound or of a polar compound of the type disclosed in the application of Driscoll and Haseltine, Jr., filed June 11, 1971.

Another preferred embodiment is a hydrocarbon base stock, useful as a traction, fluid, comprising a mixture of substituted adamantanes derived by contacting a petroleum hydrocarbon stream which is substantially free from aromatic or olefinic unsaturation and which contains at least one perhydroaromatic hydrocarbon having three rings and at least 12 carbon atoms at a temperature in the range of −5° to +50°C. with an aluminum halide catalyst, and continuing such contact until at least a substantial proportion of the perhydroaromatic has been converted to hydrocarbon product having adamantane structure. The adamantanes so produced can be further converted by alkylation, as by the method of the aforementioned Schneider patent application.

One such blended traction fluid comprises perhydrophenanthrene, and from 0.1–10 parts, based on the perhydrophenanthrene, of cyclopentyldimethyladamantane, and can also contain one or a mixture of members selected from synthetic liquid polyolefins, naphthenic petroleum lubes and paraffinic lubes, any of which can be hydrogenated (including hydrocracked oils).

Due to the high cost of the adamantane compounds, it is only in highly specialized applications where economics will permit their use, per se, as traction fluids. However, due to their high coefficient of traction, compared with their viscosity index, the adamantanes are especially useful components for blending with other naphthenes, with branched paraffins, and with hydrogenated naphthenic or paraffinic petroleum oils in the compounding of traction fluids. Another adamantane compound which is useful as a traction fluid or as a component of a blended traction fluid, is obtained by perhydrogenation of benzyladamantal ether, which can be obtained by the method in *J. Org. Chem.*, Vol. 27, page 1933 (June, 1964).

Although there have been disclosed previously herein many processes which can be used to prepare the naphthenes and branched paraffins useful in the present invention, the following examples are presented to illustrate certain means which can be used to obtain oils which are useful as traction fluids and as components of blended traction fluids.

Example I shows the preparation of a polymerizate of α-methyl styrene containing a large proportion of 1,3,3-trimethyl-1-phenylidane and a lesser proportion of trimers and the unsaturated α-methyl styrene dimer.

Example II shows the hydrogenation of the poly(α-methyl styrene) oil of Example I to produce a hydrocarbon base oil containing about 70% of 1,1,3-trimethyl-3-cyclohexyl hydrindan.

Example III shows the preparation of a highly branched paraffin oil having a good traction coefficient and good VI, by hydrogenation of the oil obtained by thermal cracking of high molecular weight polyisobutylene.

Example IV shows the preparation of a branched paraffin oil by hydrogenation of poly-1,3-(3-methylbutene-1).

Example V shows the preparation of a branched paraffin oil by hydrogenation of a liquid polymer of 2,3-dimethylbutene-1.

Example VI illustrates the advantageous performance in a traction transmission of two of the traction fluids of our invention, in comparison with a conventional naphthenic lube (Oil 35) and a polybutene fluid prepared by polymerization of a mixed butylene stream (Oil 23).

EXAMPLE I 466 g. of a commercial α-methyl styrene polymer, obtained by conventional acid-catalyzed polymerization, is placed in a 1-liter round bottomed flask, attached to a 1-inch column, and dry distilled with essentially no reflux or fractionation at a pot temperature of about 290°C., and a vapor temperature of about 210°C. under a vacuum of about 6 millimeters of mercury. 373 g. of distillate are obtained and about 73 grams of material remain in the bottom of the flask at the end of the distillation. The commercial α-methyl styrene polymer has a softening point of 210°F., a Gardner-Holdt viscosity of J-L, a specific gravity of 1.075, a refractive index at 20°C. of 1.61, a molecular weight of 685, an iodine number of 0, an acid number of 0, and a saponification number of 0.

EXAMPLE II 300 g. of the distillation product of Example I is placed in a 316 stainless steel bomb along with 7.5 grams of Raney nickel catalyst and the bomb is pressured to 3000 p.s.i.g. of 100% hydrogen while heat is applied until the temperature in the bomb is 150°C. At that point an exothermic reaction occurs and heating is discontinued. The temperature is allowed to rise to about 220°C. and the hydrogen pressure is maintained at 3000 p.s.i. for 6 hours at which time the bomb is slowly cooled to ambient temperature while maintaining the hydrogen pressure at 3000 p.s.i. in order to avoid dehydrogenation of the hydrogenated product. The resulting perhydrogenated poly(α-methyl styrene) oil is topped to removed components boiling below 125°C. The properties of the remaining perhydrogenated product are listed in Table II of U.S. Pat. No. 3,595,796 as Oil5. The traction coefficient of this fluid is determined in an apparatus similar to that of Rounds, F. G., *J. CJE Data*, 5, pp. 499–507 (1960), employing two steel thrust ball bearings and requiring 170 ml. of lubricant, by measuring the torque transmitted through the bearings as a function of load, speed, and oil temperature. The coefficients calculated from these measurements are reported in Table II of U.S. Pat. No. 3,595,796. The fluid is also tested as a lubricant in a dynamometer mounted prototype transmission in which speeds of 2000–3000 ft./min. are used and in an actual automobile with a torque transmission. The performance in these tests proves that the oil is satisfactory as a traction fluid; however, the temperature properties of this oil do not suit it for automotive use. Analysis by nuclear magnetic resonance (NMR) shows the oil of this example to contain about 20% of trimers (mostly hydrindan), about 10% of 2,4-(dicyclohexyl)-2-methyl pentane, and about 70% of 1,1,3-trimethyl-3-cyclohexyl hydrindan (more correctly termined 1-cyclohexyl-1,3,3-trimethyl hydrindan).

EXAMPLE III

A commercially available polyisobutylene polymer, having a molecular weight of 10,000, and having been prepared by low temperature polymerization with $AlCl_3$ catalyst, is thermally cracked as in Example I. About 50% of the polymer cracks to isobutylene and the remainder is hydrogenated using an 0.5% palladium on charcoal catalyst at 275°C. and 1500 p.s.i. of hydrogen for 8 hours. The resulting hydrogenated polyisobutylene oil has the properties shown in Table II of U.S. Pat. No. 3,595,796 for Oil 34, and has a large NMR peak at 8.58$\tau$ and almost no NMR peak at 8.84–8.85 $\tau$.

EXAMPLE IV

A dry 1-quart pop bottle is charged with 235 grams of dry, pure 3-methylbutene-1, 16 ml. of a 1 molar solution of $Al_2Et_3Cl_3$ in cyclohexane, and 14 ml. of a 1 molar solution of $TiCl_4$ in hexane. The reaction proceeds at 30°C. for 20 hours. The reaction mixture is then stirred with 5 ml. of concentrated ammonium hydroxide for ½ hour and the catalyst residue filtered from the product. Solvent is stripped from the product, by distillation and the resulting solvent-free oil is distilled at about 0.5 mm. Hg. to remove products boiling below 150°C. 104 g. of an oily bottoms product is obtained, having a kinematic viscosity of 175 cs. at 210°F. The structure of the polymeric units is established by NMR analysis to be the 1,3-addition product rather than the expected 1,2-addition. That is, the product corresponds to poly-1,3-(3-methylbutene-1). It is cracked and hydrogenated as in Example III and the resulting oil fractionated. One of the fractions of this oil is shown in Table II of U.S. Pat. No. 3,595,796 as Oil 31. Another method of making oils containing poly-3-methylbutene-1, which upon hydrogenation are useful as traction fluids or components of traction fluids, is shown in Belgian Pat. No. 663,549. Also useful is poly-2-methylbutene-1 (see U.S. Pat. No. 2,274,031) which upon hydrogenation makes a good component for a traction fluid.

EXAMPLE V 2,3-Dimethylbutene-1 is contacted as in Example IV at 30°C. for 20 hours with a catalyst prepared from 1.17 moles of ethyl aluminum susquechloride and 1 mole of titanium tetrachloride. Unreacted monomer is removed, by distillation, from the catalyst-free reaction mixture to obtain 72% yield of an oil. This oil is hydrogenated as in Example III. The properties of the hydrogenated oil are shown in Table II of U.S. Pat. No. 3,595,796, and Oil 9.

The liquid polymers of 2,3-dimethylbutene-1 are valuable as traction fluids or as components of traction fluids, due to their thermal and oxidative stability as can be seen from inspection of the properties reported for Oil 9 in Table II. Higher molecular weight polymers can be prepared from 2,3-dimethylbutene-1 using a cationic system, as with $BF_3$ catalyst, at low temperature (as −78°C.). For example, with $BF_3$ at −78°C. a yield of 13.5%, based on the olefin charged is obtained of a high molecular weight polymer 2,3-dimethylbutene-1which is optically clear, though, and has a high molecular weight (intrinsic viscosity of 0.1 at 30°C. in cyclohexane). These high polymers are useful as additives for wax formulations in order to provide increased hardness and strength.

EXAMPLE VI

The oil (Oil 5) of Example I is tested in a traction transmission similar to that of FIGS. 1 and 2. Similarly, Oils 1, 23 and 35 of Tables I and II of U.S. Pat. No. 3,595,796 are also tested in this transmission. A comparison of the maximum torque which can be obtained without slippage with each of these four fluids in the transmission is shown in Table V below, along with the viscosity index and the coefficient of traction obtained in the laboratory test device at 500,000 p.s.i., 200°F., and 1000 ft./min. It can be seen that Oil 1 possesses the best combination of traction properties and fluidity properties (e.g., the viscosity index). Oil 1 has only 9% greater coefficient of traction in the laboratory device than Oil 23 and yet is able to withstand 32% greater torque without slippage than can Oil 23. Note also that Oil 5, containing about 20% of perhydrogenated $\alpha$-methyl styrene trimers, has the best traction properties but has the lowest viscosity index of the four oils.

In general, naphthene-paraffin blends (such as oil No. 1 in the above Table IV) can be compounded from polymeric reaction products of at least one of the olefinic hydrocarbon monomers taken from the group consisting of ethylenes, propene, butenes, pentenes, hexenes, heptenes and octenes, including copolymers of two or more of such monomers, said polymeric reaction product being substantially free from olefinic unsaturation. The usual oils prepared from polyolefins and copolymers of polyolefins have considerable olefinic unsaturation, for example, one commercially available polybutene has an iodine number of 48. Preferably, oils prepared from such highly unsaturated polyolefins are hydrogenated to produce a hydrogenated polyolefin oil which is substantially free from olefinic unsaturation. Preferably, the oils have an iodine number less than 5, more preferably, less than 2. More preferred than the iodine number as a means of defining residual olefinic unsaturation in polymers which are substantially free from olefinic unsaturation is the ultraviolet absorption in the region of 190–195 millimicrons (herein sometimes referred to as 195 UCA). Preferred fluids are a hydrogenated polypropylene having a 195 UVA no greater than 2.0 (e.g., 1.88), even more preferred is a hydrogenated polybutene having a 195 UVA less than 1.0 (e.g., 0.77). Less preferred, but operable blended fluids can be prepared by blending one or more naphthene hydrocarbons with the polymeric reaction product of at least one of the olefinic monomers taken from the group consisting of propene, butenes, and pentenes, said polymer having a molecular weight of 300 to 500. Fluids comprised of such polymeric reaction products are useful in the combination of a friction drive machine comprising a power input member and a power output member in tractive rolling contact relationship, an oxidation-resistant fluid film between said members and said fluid. Similarly, such fluids comprised of such polymeric reaction products are useful in the combination of a toric transmission mechanism comprised of at least 2 axially aligned opposing power transmitting race members, each having a toric raceway in its opposing face and at least one roller member disposed between said race members in tractive rolling contact relationship with each of said raceways, a fluid film between said racers and roller at the points of contact and said fluid. Examples are such a friction drive or such a toric transmission mechanism wherein said fluid is comprised of polybutene having a molecular weight of about 400, and preferably, wherein said polybutene is a hydrogenated polybutene.

Useful blended traction fluids similar to the naphthene-paraffin blend of Table IV can be prepared by blending at least 5 volume percent (more preferably, at least 15 volume percent) of the polymeric reaction product of at least one of the olefinic hydrocarbon monomers taken from the group consisting of ethylene, propene, butenes, pentenes, hexenes, heptenes and octenes (most preferably, said polymeric reaction product having been hydrogenated so as to be substantially free from olefinic unsaturation) and as the naphthene component a $C_{12}$–$C_{70}$ organic liquid having at least one saturated ring having a coefficient of traction of at least 0.06 as defined in French Pat. No. 1,541,833. The naphthene component can be a fused, saturated compound having from 2 to 0 fused rings and a total carbon atom content of from about 9 to about 60 as described in U.S. Pat. No. 3,411,369. The paraffinic or non-naphthene component of a useful blended traction fluid can be a hydrocarbon having an acyclic structure with at least three quarternary carbon atoms, as described in French Pat. No. 1,541,833. In general, blended traction fluids can be prepared wherein at least one component is selected from the group consisting of paraffins, branched olefins hydrogenated paraffinic lube oil (preferably containing less than 1% gel aromatics), hydrogenated naphthenic lube oil (preferably containing less than 1% aromatics), and synthetic paraffin oils, (e.g., hydrogenated polymeric reaction product of at least one $C_2$–$C_8$ olefinic hydrocarbon monomer, preferably wherein the hydrogenated polymeric reaction product is substantially free from olefinic unsaturation) and as a second component at least one member selected from the group consisting of $C_{12}$–$C_{70}$ organic liquids having a coefficient of traction of at least 0.06, at least one saturated ring and wherein up to eight carbon atoms may be replaced with oxygen or phosphorous atoms, and fused, saturated compounds having from 2 to 9 fused rings and a total carbon atom content of from about 9 to about 60, up to eight of which atoms can be replaced by atoms selected from the group consisting of oxygen, nitrogen, phosphorous and silicone (e.g., see U.S. Pat. No. 3,411,369 and French Pat. No. 1,541,833). One useful liquid, having at least one saturated ring is 1,3-(5.7-dimethyl)adamantyl dipelargonate (DMAP).

In general, the choice of molecular weight of components of traction fluids is determined primarily by the desired viscosity characteristics of the fluid (taking into consideration the effect of any other components, such as low VI naphthenes or highly viscous VI improvers). The following are examples of the relationship between the average molecular weight of polyolefin oils and the viscosity at 210°F.

| Oil No. From Tables I & II of U.S. Pat. No. 3,595,796 | $KV_{210}$ F. | Average Mol. Weight |
|---|---|---|
| 25 | 5.679 | 457 |
| 31 | 5.47 | 361 |
| 44 | 8.50 | 555 |

The traction coefficients given in the attached Table II were obtained by the test procedure and apparatus described by Rounds, F. G., *Journal of C& E Data*, 5, No. 4, pp. 499–507 (1960). In Table II, ASTM Oil No. 3 can be used as a reference point or standard for comparison with other test reports. It should be noted that these numbers in Table II are considerably lower in magnitude than the traction coefficients reported in the aforementioned U.S. Pat. Nos. 3,411,369 and 3,440,894 of William C. Hammann and Rober G. Schisla. In order to provide common basis for comparing the present data with that of said patents, the following traction coefficients are presented, as measured by the Rounds method:

| | Hammond et al. | Method of Rounds | | | |
|---|---|---|---|---|---|
| p.s.i. | 400,000 | | 400,000 | | 500,000 |
| ft./min. | 750 | 600 | 750 | 1000 | 1000 |
| perhydro-.O-Terphenyl (Oil B) | .073 | .065 | .063 | .062 | .050 |
| Cosden Polybutene (Oil 23) | .060 | .050 | .047 | .045 | .044 |
| ASTM Oil 3 (Oil 35) | | .042 | .039 | .037 | .042 |
| bis (2, 4, 6 trimethyl cyclohexyl) methane | .061 | .045 | .042 | .040 | .042 |
| perhydro-styrene Dimerizate (Oil 15) | | .049 | .049 | .049 | .052 |
| Tipd (Oil 17) | | .052 | .050 | .048 | .044 |
| Perhydro-polybutene (Oil 19) | | .053 | .050 | .047 | .042 |
| Perhydro-alpha-methyl styrene Dimerizate (Oil 6) | .074 | .055 | .054 | .053 | .045 |

All measurements at 200°F.

Due to day-to-day test variations, all measurements are normalized, by comparison with a standard (here Oil 23) as by means of the following equation for 600 ft./min., 400,000 p.s.i. and 200°F.

$$\frac{\text{Oil 23 Measured Coefficient}}{0.045} = \frac{\text{Sample Measurement Coefficient}}{\text{Normalized Coefficient}}$$

the bis (2,4,6 trimethyl cyclohexyl) methane has a $KV_{210}$ of 2.94 cs and $KV_{100}$ of 19.61, $d(20/4)$ 0.8886, and a VTF-VI of 104. In making traction coefficient measurements by the Rounds method, the measurement is frequently made, at a number of different velocities (from 0 to 750 ft./min.) and a curve is drawn from which data at other velocities can be taken (by extrapolation).

In the present invention the preferred acyclic tractants are substantially saturated (e.g., they have a bromine number less than 5, more preferably less than 1). However, the acyclic synthetic liquid $C_3$–$C_8$ olefinic homopolymers, copolymers or terpolymers described herein can also be useful per se as tractants or as components of tractant blends.

The oxidation stability of these olefinic acyclic polymers is improved by hydrogenation, either partially (as to a bromine number in the range of 5–30) or by substantially complete saturation (e.g., perhydrogenation to produce a synthetic acyclic paraffin).

Table II reports the Tag acid number (TAN) and percent increase in kinematic viscosity at 100°F. ($KV_{100}$) of the "used oil", that is, the oil after testing for traction coefficient. Similarly, after extended use in a transmission, the increase in acid number and viscosity (caused by oxidation) can be such that the traction fluid, consisting of the base oil and lubricant additives, must be replaced. Such a "used" or "oxidized" fluid can be reclaimed or "revitalized" by contacting with an adsorbent, as by passing the oil through a column containing silica gel and activated charcoal (which can be admixed or in separate layers). Other adsorbents (e.g., fullers earth or acid-activated clay, alumina, spent alumino-silicate catalyst, etc.) or adsorbent admixtures can be used. Treatment with a Lewis acid (e.g., HF, $H_2SO_4$) preferably followed by washing, can be used instead of, or in combination with the adsorbent contacting. Such treatment will reduce or remove polar lubricant additives; therefore, the reclaimed oil can be replenished with such additives prior to reuse.

The following Table V lists many examples of hydrocarbon base stocks which have traction properties at least as good as ASTM Oil No. 3 (i.e., "Circolite") and also lists lubricants comprising such base additives. In the tables run numbers are frequently given to show where the usual run-to-run differences encountered in chemical synthesis may occur.

The following is a key to abbreviations used in the table:

"4-Ball" is the torque measurement of the fluid at room temperature using a Roxana tester or a Shell tester modified to measure torque.

"Prototype" is the traction coefficient determined in an actual automotive transmission, similar to that of FIGS. 1 and 2.

"Rounds Average" and "Rounds 500,000 p.s.i." are traction coefficients by the methods of Rounds, *Journal of CJE Data*, 5, No. 4, pp. 499–507 (1960).

"Tg °C" is the glass transition temperature.

"PAMVCH" is substantially completely hydrogenated polyalpha-methyl styrene, primarily in hydrindan form and mostly the dimer, except where otherwise indicated (e.g., "trimer").

"Oronite" is a tradename for commercially available polybutene, the indicated fluids can be distillate fractions (as indicated by their viscosity) of such fluids.

"Hyd." indicates the material was substantially fully hydrogenated (Bromine number 5 or less), unless otherwise indicated (e.g., "partially").

"Polyvis" is a tradename for a commercially available polybutene oil, the samples are usually distillates of this oil or of the oil after hydrogenation.

"PIB" indicates a thermally cracked and hydrogenated polyisobutylene oil of gem-dimethyl configuration and containing the repeating units . . . $C_{19}$, $C_{20}$, $C_{23}$, $C_{24}$, $C_{27}$, $C_{28}$ . . .etc. (see *J. Poly. Sci.* part A-1, vol. 9, 717–745 (1971).

"PVCH" is hydrogenated polystyrene, mainly dimers.

"PAMS" is polyalpha-methyl styrene, mostly indan dimer (known in the trade as "saturated" dimer) with some trimer.

"Indopol" is a commercially available polybutene oil.

"DMA" is dimethyl adamantane.

"Formolite" is an oil product from the acid-catalyzed reaction of formaldehyde with aromatic compounds (see Oil 53 of Table I for one such preparation).

"Circolite" is a tradename for ASTM Oil No. 3.

"New 98 Golden" and "New 91 Golden" are severely hydrorefined naphthenic petroleum distillates, (see Ser. No. 812,516 and 850,717).

"Sunvis 11" is a commercially available solvent refined paraffinic petroleum lube.

This application is copending with commonly-owned application filed June 23, 1971 of Irl N. Duling and David S. Gates entitled "Blended Traction Fluid Containing Cyclic Compounds", the disclosure thereof being incorporated herein by this reference.

Unless otherwise indicated, all percentages are by weight.

TABLE IV

| Oil No. | ASTM-VI | Laboratory Traction Coefficient | Maximum Torque Without Slippage |
|---|---|---|---|
| 35 (Naphthenic Lube) | −11 | 0.042 | 90 ft.-lbs. |
| 23 (Poly-Mixed Butenes) | 53 | 0.044 | 103 |
| 1 (Naphthene-Paraffin Blend) | 62 | 0.0485 | 136 |
| 5 (Hydrogenated α-Methyl Styrene Dimer) | −46 | 0.049 | 144 |

The performance of Oil 1 in the traction transmission is satisfactory for automotive use. However, the properties of Oil A in Table III of U.S. Pat. No. 3,595,797 indicate that it will allow the traction transmission to operate at an even higher torque without slippage than any of the four oils on this Table.

Proto- Rounds Rounds VTF ASTM

-continued

| | Fluid | 4-Ball | type | Average | 500,000 psi | $KV_{210}$ | $KV_{100}$ | VI | VI |
|---|---|---|---|---|---|---|---|---|---|
| | Styrenes | | | | | | | | |
| 1 | PAMVCH (50% Indan) | | | .0448 | .050 | 8.02 | 153.4 | −118 | 0 |
| 2 | PAMVCH (95% Indan) | | | .0464 | .049 | 5.50 | 60.5 | −50 | 0 |
| 3 | PAMVCH (cis-Indan) | .0857 | | | | 3.22 | 20.74 | 2 | 0 |
| 4 | PAMVCH (trans-Indan) | .0872 | | | | 4.07 | 29.36 | 22 | 0 |
| 5 | PAMVCH | .0870 | | | | 3.81 | 25.43 | 15 | 0 |
| 6 | PAMVCH | | | | | 3.91 | 27.66 | 1 | 0 |
| 7 | PAMVCH | | | | | 4.19 | 31.30 | 2 | 0 |
| 8 | PAMVCH (5.5% Trimer) | .0882 | .0594 | | | 4.49 | 37.37 | −15 | 0 |
| 9 | PAMVCH | .0883 | | | | 4.50 | 37.40 | −14 | 0 |
| 10 | PAMVCH | | | | | 4.88 | 44.95 | −25 | 0 |
| 11 | PAMVCH | .0889 | | | | 5.08 | 49.30 | −31 | 0 |
| 12 | PAMVCH | | | | | 5.12 | 50.48 | −34 | 0 |
| 13 | PAMVCH (24.8% Trimer) | .0893 | .062 | | | 6.82 | 102.0 | −88 | 0 |
| 14 | Dow PAMVCH | .0882 | | | | 4.70 | 39.87 | −8 | 0 |
| 15 | PAMVCH | | | | | 34.75 | 6301.8 | −329 | 0 |
| 16 | PAMVCH (Mostly Trimer) | | | | | 83.6 | | | |
| 17 | PAMVCH Trimer (Indan) | | | | | 120.0 | | | |
| 18 | PVCH | | | | | 2.63 | 12.85 | 20 | 9 |
| 19 | PVCH | | | .0396 | .047 | 3.30 | 20.02 | 6 | 0 |
| 20 | PVCH | .0871 | | .0470 | .052 | 8.21 | 182.8 | −170 | 0 |
| 21 | PAMS | .0729 | | | | 5.24 | 82.41 | −255 | 0 |
| 22 | PAMS | | | .0274 | .037 | 5.32 | 86.5 | −265 | 0 |
| 23 | PAMS | | | | | 2.53 | | | |
| | Polybutenes | | | | | | | | |
| 24 | Polyvis - OSH | .0801 | | (.0394) | (.044) | 4.92 | 34.90 | 54 | 53 |
| 25 | Polyvis - Hyd. | | | | | 4.15 | 25.39 | 61 | 49 |
| 26 | Polyvis - Hyd. | | | | | 4.29 | 26.6 | 63 | 53 |
| 27 | Polyvis - Hyd. | | | | | 4.37 | 27.90 | 59 | 50 |
| 28 | Polyvis - Hyd. | | | | | 4.52 | 29.09 | 63 | 57 |
| 29 | Polyvis - Hyd. | .0809 | | | | 4.54 | 29.55 | 61 | 55 |
| 30 | Polyvis - Hyd. | .810 | | | | 4.63 | 30.68 | 60 | 55 |
| 31 | Polyvis - Hyd. | | | .0414 | .042 | 5.20 | 35.99 | 69 | 74 |
| 32 | Indopol - Hyd. | .0807 | | | | 3.27 | 16.01 | 77 | 68 |
| 33 | Indopol - Hyd. | | | | | 3.83 | 20.81 | 77 | 71 |
| 34 | Oronite - Partially Hyd. | .0819 | | | | 3.20 | 15.00 | 86 | 79 |
| 35 | Oronite - Hyd. | .0821 | | .0428 | .048 | 2.84 | 12.34 | 86 | 78 |
| 36 | Oronite - Hyd. | .825 | | | | 3.15 | 14.70 | 84 | 82 |
| 37 | Oronite - Hyd. | | | | | 3.17 | 15.27 | 76 | 67 |
| 38 | Oronite - Hyd. | .0823 | | | | 3.19 | 14.93 | 86 | 79 |
| 39 | Oronite - Hyd. | .0824 | | | | 3.28 | 15.73 | 84 | 77 |
| 40 | PIB - Hyd. | | | | | 1.52 | 4.09 | 137 | — |
| 41 | PIB - Hyd. | .0850 | .0415 | .0462 | .052 | 3.22 | 13.49 | 114 | 116 |
| 42 | PIB - Hyd. | | | | | 3.84 | 18.22 | 108 | 113 |
| 43 | PIB - Hyd. | | | | | 4.35 | 22.51 | 105 | 111 |
| 44 | PIB - Hyd. | .0858 | | | | 4.92 | 28.02 | 100 | 110 |
| 45 | PIB - Hyd. | | | | | 5.91 | 37.92 | 98 | 109 |
| 46 | PIB - Hyd. | .0881 | | .0362 | .043 | 8.12 | 62.66 | 98 | |
| 47 | PIB - Hyd. | | | | | 8.70 | 69.40 | 99 | 107 |
| | Well Characterized Compounds | | | | | | | | |
| 48 | Octacosane | | | | .020 | 3.75 | (15.1) | 134 | 156 |
| 49 | Ethylene/Propylene 56/44 | | | .0266 | .026 | 8.50 | 51.5 | 130 | 136 |
| 50 | Polypropylene | | | .0272 | .033 | 4.49 | 26.77 | 80 | 80 |
| 51 | Polypropylene | | | .0310 | .040 | 5.68 | 43.53 | 60 | 67 |
| 52 | Polypropylene | | | .0320 | .036 | 9.27 | 98.14 | 64 | |
| 53 | Propylene/1-butene 51/49 | .0737 | | .0284 | .037 | 6.18 | 46.89 | 74 | 82 |
| 54 | Poly(1-butene) | | | .0368 | .039 | 7.29 | 66.48 | 60 | 69 |
| 55 | Poly(1-butene) | | | .0272 | .036 | 10.38 | 117.62 | 65 | 71 |
| 56 | Poly(1-pentene) | .0706 | | | | 3.67 | 18.14 | | 93 |
| 57 | Poly(1-hexene) | .0684 | | .0284 | .033 | 7.40 | 52.87 | 102 | 110 |
| 58 | Poly(1-octene) | | | .0234 | .029 | 3.95 | 18.89 | 109 | 115 |
| 59 | Poly(1-octene | .0641 | .015 | | | 3.93 | 18.92 | 107 | 117 |
| 60 | Poly 1,3(3-methylbutene-1) | .0788 | | .0388 | .046 | 5.47 | 46.71 | 28 | 31 |
| 61 | Poly(4-methylpentene-1) | .0783 | | .0422 | .041 | 4.80 | 36.94 | 28 | 19 |
| 62 | Poly(2,3-dimethylbutene-1) | | | | | 7.43 | 90.76 | −1 | 12 |
| 63 | Poly(2,3-dimethylbutene-1) | .0895 | | .0462 | .053 | 7.98 | 115.98 | −30 | 0 |
| 64 | Tetraisopropyldecalin-Hyd. | | | | | 6.44 | 197.4 | −584 | 0 |
| 65 | Tetraisopropyldecalin-Hyd. | .0861 | | | | 6.44 | 191 | −552 | 0 |
| 66 | Tetraisopropyldecalin-Hyd. | | | .0410 | .044 | 6.54 | 198.8 | −555 | 0 |
| 67 | Tetraisopropyldecalin-Hyd. | | | | | 7.18 | 261.15 | −602 | |
| 68 | Hyd. o-terphenyl | .0913 | .060 | .0524 | .050 | 4.18 | 40.48 | −113 | 0 |
| 69 | Hyd. o-terphenyl | | | | | 4.25 | 42.79 | −125 | 0 |
| 70 | Hyd. p-terphenyl | | | | | Solid | Solid | | |
| 71 | Dimethyladamantane | .0712 | | | | 1.16 | 2.89 | 67 | |
| 72 | DMA Dimer | .0933 | | | | 27.44 | 2,270 | −169 | 0 |
| 73 | Ethyladamantane | .0730 | | | | 1.55 | 4.42 | 111 | |
| 74 | DMA Dipelargonate | .0788 | | .0368 | .041 | 7.05 | 54.14 | 86 | |
| 75 | DMA Dicaprolate | .0864 | | | | 4.73 | 34.59 | 39 | |
| 76 | Cyclopentyl DMA | .0802 | | | | 1.72 | 5.24 | 107 | |
| 77 | Perhydrophenanthrene | .0772 | | | | 1.73 | 4.96 | 134 | |
| 78 | Hyd. 9-benzylidene fluorene | .0816 | | | | 5.56 | 83.94 | −189 | 0 |
| 79 | Di-2-ethylhexylsebacate | .0639 | | | | | | | |
| 80 | Di-indene | .0841 | | | | 4.46 | 32.38 | 28 | 10 |
| | Poorly Characterized Fluids | | | | | | | | |
| 81 | Monsanto HB-40 | .0738 | | | | 3.82 | 30.39 | −57 | 0 |
| 82 | Amoco BM-1 | .0743 | | | | 4.26 | 51.72 | −243 | 0 |
| 83 | Hyd. Amoco BM-1 | .0819 | | | | 3.73 | 33.46 | −137 | 0 |
| 84 | Hyd. Formolite | | | .0392 | .045 | 6.27 | 77.29 | −47 | 0 |

-continued

| | | | | | | | | | |
|---|---|---|---|---|---|---|---|---|---|
| 85 | Dixylyl methane-Hyd. | .0819 | | | | 1.99 | 7.55 | 39 | — |
| 86 | Tritotyl dimethane-Hyd. | .0909 | | | | 8.09 | 162.0 | −133 | 0 |
| 87 | Ditetralyl Methane-Hyd. | .0903 | | | | 10.75 | 272.5 | −122 | 0 |
| 88 | Trixylyl Dimethane-Hyd. | .0845 | | | | 10.03 | 340.0 | −257 | 0 |
| 89 | 4-Ring Formolite-Hyd. | | | | | 30.70 | 6.900 | −484 | 0 |
| 90 | Hyd. Transil Stock | | | .0416 | .044 | 2.24 | 8.88 | 61 | 55 |
| 91 | Circolite | | | .0340 | .042 | 4.41 | 33.43 | 12 | 0 |
| 92 | Circolite | .0768 | | | | 4.42 | 33.43 | 13 | 0 |
| 93 | Hyd. Circolite | | | .0372 | .042 | 4.66 | 34.31 | 34 | 22 |
| 94 | New 98 Golden | | | .0298 | .038 | 4.64 | 35.92 | 18 | 3 |
| 95 | Hyd. New 98 Golden | | | .0392 | .043 | 4.56 | 32.39 | 39 | 27 |
| 96 | Hyd. New 98 Golden | | | .0416 | .047 | 4.31 | 29.16 | 41 | 24 |
| 97 | Hyd. New 91 Golden | | | | | 3.55 | 20.47 | 46 | 27 |
| 98 | Hyd. 3-G Extract | | | .0348 | .038 | 5.13 | 55.89 | −72 | 0 |
| 99 | SunVis 11 | .0717 | | | | 4.38 | 23.61 | 98 | |
| 100 | Hyd. SunVis 11 | .0719 | | | | 3.99 | 20.51 | 96 | |
| 101 | Hyd. SunVis 11 | | | | | 4.24 | 22.35 | 98 | 103 |
| 102 | Hyd. Resin Piccolyte S-10 | .0768 | | | | 6.93 | 69.90 | 32 | 40 |
| 103 | Hyd. Piccovar AP10 | .0822 | | | | 3.27 | 20.53 | −12 | 0 |
| 104 | Coal Tar Distillate | .0787 | | | | 4.50 | 67.99 | −367 | 0 |
| 105 | Coal Tar Distillate-Hyd. | .0818 | | | | 4.01 | 42.93 | −202 | 0 |
| 106 | Syn. Lube Care Lab 321 | .0645 | | | | 3.51 | 13.60 | 136 | 157 |
| | PAMVCH/Polyisobutylene - Hyd. | | | | | | | | |
| 107 | 30/70 506566/506649-10 | | | .043 | .043 | 4.39 | 29.60 | 46 | 31 |
| 108 | 50/50 485564/485555-1 | | | .0472 | .048 | 6.69 | 59.1 | 55 | 62 |
| 109 | 50/50 506581/532570-10 | .0869 | | | | 4.33 | 26.16 | 73 | 69 |
| 110 | 50/50 506566/532645-1 | .0887 | .0522 | | | 3.72 | 19.91 | 76 | 69 |
| 8 | PAMVCH | .0882 | | | | 4.49 | 37.37 | −15 | 0 |
| 111 | 95/5 506566/532570-10 | .0886 | | | | | | | |
| 112 | 90/10 506566/532570-10 | .0886 | | | | 4.54 | 35.08 | 13 | 0 |
| 113 | 80/20 506566/532570-10 | .0895 | | | | 4.56 | 33.41 | 31 | 15 |
| 114 | 70/30 506566/532570-10 | .0897 | | | | 4.58 | 31.88 | 46 | 35 |
| 115 | 60/40 506566/532570-10 | .0899 | | | | 4.61 | 30.74 | 58 | 52 |
| 116 | 50/50 506566/532570-10 | .0900 | | | | 4.63 | 29.60 | 69 | 66 |
| 117 | 40/60 506566/532570-10 | .0898 | | | | 4.67 | 29.30 | 74 | 74 |
| 118 | 30/70 506566/532570-10 | .0893 | | | | 4.75 | 28.40 | 87 | 92 |
| 119 | 20/80 506566/532570-10 | .0885 | | | | 4.79 | 28.05 | 92 | 99 |
| 120 | 10/90 506566/532570-10 | .0870 | | | | 4.87 | 27.88 | 98 | 106 |
| 44 | PIB | .0858 | | | | 4.92 | 28.02 | 100 | 110 |
| | PAMVCH Trimer/Polyisobutylene - | | | | | | | | |
| 121 | 30/70 506567-10/532538-10 | .0916 | .0530 | .0468 | .049 | 8.57 | 89.36 | 57 | 66 |
| 122 | 30/70 t06592/506649-10 | .0894 | | | | 7.60 | 76.7 | 47 | |
| | PAMVCH/Polyvis-OSH | | | | | | | | |
| 123 | 50/50 485658/475766 | | | .0438 | .048 | 4.40 | 30.02 | 43 | 28 |
| | PAMVCH/Polyvis - Hyd. | | | | | | | | |
| 124 | 10/90 506566/506563 | .0807 | | .0448 | .047 | 4.29 | 27.02 | 60 | 49 |
| 125 | 30/70 506520/506509-2 | | | .0493 | .055 | 4.50 | 30.28 | 51 | 41 |
| 126 | 50/50 506520/506509-2 | | | .0442 | .055 | 4.55 | 32.10 | 41 | 28 |
| 127 | 50/50 506566/506563 | .0859 | .0530 | | | 4.27 | 28.60 | 42 | 24 |
| 128 | 50/50 506566/532610 | .0860 | .0515 | | | 4.44 | 30.60 | 42 | 28 |
| 129 | 50/50 (Cleaned up 714–35) | .0854 | | | | 4.45 | 30.93 | 40 | 25 |
| 8 | PAMVCH | .0882 | | | | 4.49 | 37.37 | −15 | 0 |
| 130 | 50/50 506566/532591-1 | .0854 | | | | 4.41 | 29.90 | 45 | 31 |
| 29 | Polyvis - Hyd. | .0809 | | | | 4.54 | 29.55 | 61 | 55 |
| 8 | PAMVCH | .0882 | | | | 4.49 | 37.37 | −15 | 0 |
| 131 | 90/10 506566/506563 | | | | | 4.46 | 34.37 | 10 | 0 |
| 132 | 75/25 506566/506563 | .0861 | | | | 4.36 | 31.37 | 26 | 4 |
| 133 | 50/50 506566/506563 | .0859 | | | | 4.27 | 28.60 | 42 | 24 |
| 134 | 25/75 506566/506563 | | | | | 4.28 | 27.16 | 57 | 31 |
| 135 | 10/90 506566/506563 | .0807 | | | | 4.29 | 27.02 | 60 | 49 |
| 28 | Polyvis - Hyd. | .0781 | | | | 4.29 | 26.65 | 63 | |
| | PAMVCH/Indopol - Hyd. | | | | | | | | |
| 136 | 45/55 506581/506626-1 | | | .044 | .046 | 3.47 | 18.99 | 57 | 42 |
| 137 | 50/50 506566/532622 | .0867 | .0515 | | | 4.05 | 25.35 | 50 | 33 |
| 8 | PAMVCH | .0882 | | | | 4.49 | 37.37 | −15 | 0 |
| 138 | 50/50 506566/506626-1 | .0864 | | | | 3.75 | 22.04 | 52 | 35 |
| 32 | Indopol - Hyd. | .0807 | | | | 3.27 | 16.01 | 77 | 68 |
| | PAMVCH/Oronite - Hyd. | | | | | | | | |
| 139 | 50/50 506566/532624 | .0877 | .0515 | | | 3.69 | 21.55 | 50 | 33 |
| 140 | 46/54 532046-4/592680-1 | .0515 | | | 3.62 | 20.25 | 59 | 45 | |
| 141 | 50/50 506544/532680-1 | .0869 | .0525 | | | 3.82 | 22.91 | 50 | 35 |
| 142 | 61/39 506544/532680-1 | .0881 | .0545 | | | 4.04 | 26.07 | 41 | 20 |
| 143 | 60/40 544510-1/532680-1 | .0877 | .0560 | | | 4.65 | 35.70 | 21 | 7 |
| 144 | 75/25 544510-1/532680-1 | .0580 | | | 5.26 | 48.84 | −10 | 0 | |
| 145 | 50/50 32670-3/532680-1 | .0861 | | | | | | | |
| 8 | PAMVCH | .0882 | | | | 4.49 | 37.37 | −15 | 0 |
| 146 | 50/50 506566/506515 | .0874 | | | | 3.55 | 19.67 | 58 | 43 |
| 35 | Oronite | .0821 | | | | 2.84 | 12.34 | 86 | 78 |
| 5 | PAMVCH (3.81) | .0872 | | | | 3.81 | 25.4 | 15 | |
| 147 | 75/25 532670-3/532677 | .0867 | | | | 3.57 | | | |
| 148 | 50/50 532670-3/533677 | .0858 | | | | 3.40 | | | |
| 149 | 25/75 532670-3/532677 | .0844 | | | | 3.26 | | | |
| 36 | Oronite | .0825 | | | | 3.15 | 14.70 | 84 | 82 |
| 9 | PAMVCH (450) | .0884 | | | | 4.50 | 37.4 | −14 | 0 |
| 150 | 75/25 532646-4/532677 | .0875 | | | | 4.04 | | | |
| 151 | 50/50 532646-4/532677 | .0862 | | | | 3.67 | | | |
| 152 | 25/75 532646-4/532677 | .0846 | | | | 3.39 | | | |
| 36 | Oronite | .0825 | | | | 3.15 | 14.70 | 84 | 82 |

-continued

| | | | | | | | | | |
|---|---|---|---|---|---|---|---|---|---|
| 11 | PAMVCH (508) | .0889 | | | | 5.08 | 49.3 | −31 | 0 |
| 153 | 75/25 506544/532677 | .0880 | | | | 4.40 | | | |
| 154 | 50/50 506544/532677 | .0870 | | | | 3.87 | | | |
| 155 | 25/75 506544/532677 | .0851 | | | | 3.47 | | | |
| 36 | Oronite | .0825 | | | | 3.15 | 14.70 | 84 | 82 |
| 13 | PAMVCH (682) | .0893 | | | | 6.82 | 101.97 | −87 | 0 |
| 156 | 75/25 544510-1/532680-1 | | | | | 5.43 | 52.34 | −9 | 0 |
| 157 | 50/50 544510-1/532680-1 | | | | | 4.43 | 31.21 | 35 | 19 |
| 158 | 25/75 544510-1/532680-1 | | | | | 3.75 | 21.12 | 64 | 52 |
| 38 | Oronite | .0823 | | | | 3.19 | 14.93 | 86 | 79 |
| | PAMVCH/Oronite - Partially Hyd. | | | | | | | | |
| 159 | 50/50 532670-3/532600-2 | .0864 | | | | | | | |
| | Hyd. Polystyrene/Polyisobutylene | | | | | | | | |
| 160 | 170 PVCH | | | .0390 | .047 | 4.38 | 28.88 | 52 | 40 |
| | 30 PIB | | | | | | | | |
| 161 | 50 PVCH | .0400 | | .0400 | .048 | 5.27 | 40.25 | 49 | 52 |
| | 50 PIB | | | | | | | | |
| 162 | 30 PVCH | | | .0412 | .048 | 5.17 | 37.48 | 58 | 61 |
| | 70 PIB | | | | | | | | |
| 163 | 50 PVCH 485687-1 | .0839 | | | | 1.95 | 6.67 | 87 | — |
| | 70 PIB 544525-2 | | | | | | | | |
| | Polyisobutylene/Polyvis Hyd. | | | | | | | | |
| 164 | 50 506649-10 | | | .046 | .046 | 4.32 | 24.58 | 84 | 84 |
| | 50 506679-10 | | | | | | | | |
| 165 | 50 532538-10 | | | .0436 | .050 | 4.09 | 22.31 | 86 | 86 |
| | 50 506679-10 | | | | | | | | |
| 166 | 50 532645-1 | | .0440 | | | 3.83 | 19.73 | 90 | 90 |
| | 50 532610 | | | | | | | | |
| 44 | PIB | .0858 | | | | | | | |
| 167 | 90/10 532570-10/532610 | .0862 | | | | | | | |
| 168 | 80/20 532570-10/53210 | .0857 | | | | | | | |
| 169 | 70/30 532570-10/53210 | .0845 | | | | | | | |
| 170 | 60/40 532570-10/53210 | .0842 | | | | | | | |
| 171 | 50/50 532570-10/53210 | .0835 | | | | | | | |
| 172 | 40/60 532570-10/53210 | .0835 | | | | | | | |
| 173 | 30/70 532570-10/53210 | .0828 | | | | | | | |
| 174 | 20/80 532570-10/53210 | .0817 | | | | | | | |
| 175 | 10/90 532570-10/53210 | .0813 | | | | | | | |
| 30 | Polyvis | .0810 | | | | | | | |
| | Polyisobutylene/Polybutene | | | | | | | | |
| 176 | 50 PIB 532570-10 | .0842 | | | | | | | |
| | 50 Indopol 506626-1 | | | | | | | | |
| 177 | 50 PIB 532570-10 | .0827 | | | | | | | |
| | 50 Oronite 506515 | | | | | | | | |
| | Miscellaneous Blends | | | | | | | | |
| | Cyclohexyl DMA | | | | | 3.03 | 16.46 | 22 | 5 |
| 178 | 67/33 532655-2/544516 | .0841 | | | | (3.28) | 16.28 | (74) | 64 |
| 179 | 40/60 532655-2/544516 | .0836 | | | | 3.16 | 15.93 | 62 | 48 |
| 39 | Oronite | .0824 | | | | 3.28 | 15.73 | 84 | 77 |
| 17 | PAMVCH Trimer | | | | | | | | |
| 180 | 67/33 506592/544516 | .0893 | | | | 19.55 | 1,312 | −221 | 0 |
| 181 | 40/60 506592/544516 | .0876 | | | | 7.40 | 93.67 | −11 | 2 |
| 39 | Oronite | .0824 | | | | 3.28 | 15.73 | 84 | 77 |
| 72 | DMA Dimer | .0933 | | | | 27.44 | 2,270 | −169 | 0 |
| 182 | 75/25 41568-1/544516 | .0918 | | | | 11.84 | 269.3 | −54 | 0 |
| 183 | 49/51 41568-1/544516 | | | | 6.67 | 69.47 | 17 | 24 | |
| 184 | 30/70 41568-1/532680-1 | .0874 | | | | 5.06 | 38.50 | 42 | |
| 39 | Oronite | .0824 | | | | 3.28 | 15.73 | 84 | 77 |
| 185 | 40 PVCH | | | | .039 | 4.24 | 29.15 | 33 | 12 |
| | 60 Polypropylene | | | | | | | | |
| 186 | 5 PAMS 506580-6 | | | .0480 | .050 | 4.28 | 33.89 | −12 | 0 |
| | 95 PAMVCH 506566 | | | | | | | | |
| 187 | 75 PAMS 532572-1 | .0877 | | | | 4.50 | 37.26 | −13 | 0 |
| | 99 PAMVCH 506566 | | | | | | | | |
| 188 | 5 PAMS 532572-1 | .0848 | | | | 4.53 | 36.72 | −3 | 0 |
| | 95 PAMVCH 506506 | | | | | | | | |
| 189 | 10 PAMS 532572-1 | .0830 | | | | 4.45 | 36.68 | −14 | 0 |
| | 90 PAMVCH | | | | | | | | |
| 190 | 60 PAMS 532572-1 | .0778 | | | | | | | |
| | 40 PAMVCH 506566 | | | | | | | | |
| 191 | 70 Formolite 4R 532566-2 | .0883 | | | | 7.45 | 69.05 | 60 | 69 |
| | 30 PIB 532570-10 | | | | | | | | |
| 192 | 50 Hyd New 98G 506510-3 | | | .0466 | .054 | 4.95 | 32.56 | 73 | 76 |
| | 50 PIB 506518 | | | | | | | | |
| 193 | 50 Hyd New 98G 4885590 | | | .0406 | .043 | 4.32 | 28.33 | 50 | 36 |
| | 50 Polyvis Hyd 506563 | | | | | | | | |
| 194 | 15 PAMVCH 485594 | | | .0398 | .043 | 4.32 | 30.16 | 32 | 12 |
| | 85 New 91G Hyd 485593 | | | | | | | | |
| 195 | 50 PAMVCH 506566 | | | .0422 | .046 | 4.38 | 31.93 | 23 | 1 |
| | 50 New 98C Hyd 485590 | | | | | | | | |
| 196 | 50 PAMVCH 506581 | .0826 | | .042 | .044 | 3.97 | 22.46 | 73 | 66 |
| | 50 Hyd Sunvisll 506611-3 | | | | | | | | |
| 197 | 50 PAMVCH 506581 | | | .0444 | .047 | 2.87 | 14.17 | 44 | 31 |
| | 50 Hyd Transil 506582 | | | | | | | | |
| 198 | 50 PAMVCH 506566 | .0775 | | .040 | .040 | 3.90 | 20.88 | 84 | 81 |
| | 50 18-H 506623-1 | | | | | | | | |
| 199 | 50 18-H 506623-1 | .0736 | | .035 | .034 | 3.97 | 20.74 | 92 | 93 |
| | 50 Polyvis 506627-10 | | | | | | | | |
| 200 | 25 18-H 506623-1 | .0798 | | | | 4.08 | 20.26 | 105 | 111 |

-continued

| | | | | | | | | | |
|---|---|---|---|---|---|---|---|---|---|
| | 75 PIB 506649-1 | | | | | | | | |
| 201 | 50 Poly(2,3DMB-1) 506681 | .0871 | | .0460 | .048 | 5.55 | 39.95 | 70 | 77 |
| | 50 PIB 506649-1 | | | | | | | | |
| 202 | 50 Polypentene 485501-10 | .0781 | | | | | | | |
| | 50 Oronite 532680-1 | | | | | | | | |
| 203 | 50 Poly(2,3DMB-1) 506681 | .0815 | | | | 5.45 | 44.78 | 37 | 41 |
| | 50 Polyvis 506679-1 | | | | | | | | |
| 204 | 10 TIPD 506636-2 | .0816 | | .041 | .043 | 4.27 | 28.20 | 46 | 30 |
| | 90 Polyvis 506622-10 | | | | | | | | |
| 205 | 30 TIPD 506583 | | | .0408 | .045 | 4.62 | 37.27 | 4 | 0 |
| | 70 Polyvis 506563 | | | | | | | | |
| 206 | 50 TIPD 50683 | | | .0458 | .048 | 4.93 | 51.99 | −75 | 0 |
| | 50 Polyvis 506563 | | | | | | | | |
| 207 | 70 TIPD 506636-2 | .0843 | | .040 | .041 | 5.71 | 90.28 | −198 | 0 |
| | 30 Polyvis 506622-10 | | | | | | | | |
| 208 | 10 Hy.O-Terphen 532506 | .0844 | | | | 4.20 | 27.59 | 54 | 41 |
| | 50 Polyvis 506679-10 | | | | | | | | |
| 209 | 10 Hy.P-Terphen 506669 | .0819* | | | | 4.38 | 28.18 | 58 | |
| | 90 Polyvis 506679-10 | | | | | | | | |
| 210 | 30 Hy.O-Terphen 532506 | .0886 | | | | 4.15 | 23.80 | 77 | |
| | 70 PIB 506649-10 | | | | | | | | |
| 211 | 30 Hy.O-Terphen 532506 | .0824 | | | | 4.16 | 27.60 | 39 | |
| | 70 Polyvis 506679-10 | | | | | | | | |
| 212 | 50 Hy.O-Terphen 532506 | .0885 | .0530 | .0504 | .049 | 3.85 | 23.13 | 51 | 34 |
| | 50 PIB 532538-10 | | | | | | | | |
| 213 | 50 Hy.O-Terphen 532616 | | .0530 | | | 3.55 | 19.91 | 54 | 38 |
| | 50 PIB 532538-10 | | | | | | | | |
| 214 | 50 Hy.O-Terphen 532506 | .0849 | | | | 4.05 | 29.10 | 8 | |
| | 50 Polyvis 506679-10 | | | | | | | | |
| 215 | 33 PAMVCH 506566 | | | .039 | .039 | 3.96 | 21.84 | 79 | 74 |
| | 33 Polyoctene 506623-1 | | | | | | | | |
| | 33 Polyvis 506322-10 | | | | | | | | |
| 216 | 33 PAMVCH 506566 | | | .0464 | .051 | 3.96 | 22.33 | 74 | 66 |
| | 33 Polyvis 532610 | | | | | | | | |
| | 33 PIB 532645 | | | | | | | | |
| 217 | 33 PAMVCH 506566 | .0868 | | | | | | | |
| | 33 PIB 532570-10 | | | | | | | | |
| | 33 Polyvis 532610 | | | | | | | | |
| 218 | 50 PAMVCH 506566 | .0871 | | | | | | | |
| | 25 PIB 532570-10 | | | | | | | | |
| | 25 Polyvis 532610 | | | | | | | | |
| 219 | 50 PAMVCH 506566 | .0893 | | | | | | | |
| | 45 PIB 532570-10 | | | | | | | | |
| | 5 Polyvis 532610 | | | | | | | | |
| 220 | 25 PAMVCH 506566 | .0884 | | | | | | | |
| | 70 PIB 532570-10 | | | | | | | | |
| | 5 Polyvis 532610 | | | | | | | | |
| 221 | 85 PAMVCH 506566 | .0885 | | | | | | | |
| | 5 PIB 532570-10 | | | | | | | | |
| | 10 Polyvis 532610 | | | | | | | | |
| 222 | 15 PAMVCH 506566 | .0841 | | | | | | | |
| | 15 PIB 532570-10 | | | | | | | | |
| | 70 Polyvis 532610 | | | | | | | | |
| 223 | 33 PAMVCH 506566 | .0871 | | | | | | | |
| | 33 PIB 532570-10 | | | | | | | | |
| | 33 Indopol 506626-1 | | | | | | | | |
| | A | | | | | | | | |
| 224 | 1/2% Ethyl 702 | .0859 | (Control | .0848) | | | | | |
| 225 | 2% Acryloid 983 (disper.) | .0846 | (Control | .0848) | | | | | |
| 226 | 1/2% TCP (EP) | .0848 | (Control | .0848) | | | | | |
| 227 | 1/2% NASUL BSN (REC) | .0847 | (Control | .0848) | | | | | |
| 228 | All above four | .0842 | (Control | .0848) | | | | | |
| 229 | 1/2% LZ 1360 (EP) | .0852 | (Control | .0858) | | | | | |
| 230 | 1/2% Ultraphos (EP) | .0857 | (Control | .0858) | | | | | |
| 231 | 4.7% LZ 284 (GM pkg) | .0854 | (Control | .0858) | | | | | |
| 232 | 6.75% K236 (New Ford pkg) | .0860 | (Control | .0858) | | | | | |
| 233 | 5.0% LZ 280 (Old Ford pkg) | .0851 | (Control | .0857) | | | | | |
| 234 | 2% LZ 895 (disper.) | .0856 | (Control | .0858) | | | | | |
| 235 | Trac Pkg | .0849 | (Control | .0848) | | | | | |
| 236 | 10% Cyclohexanol | .0826 | (Control | .0857) | | | | | |
| 237 | PAMVCH + .1% Valeric Acid | | | .0464 | .045 | 4.49 | 37.37 | −15 | 0 |
| | Control | .0882 | .0194 | | | | | | |
| 238 | New 98 Golden + Pkg Y | | | .0332 | .040 | | | | |
| | Control | | | .0298 | .038 | | | | |
| 239 | PAMVCH + 2.7% Acryloid | .0856 | .058 | | | 6.49 | 53.18 | 70 | 78 |
| | W-1600 (VI) | | | | | | | | |
| 240 | PAMVCH + 5% Acryloid | | | .0436 | .047 | 9.30 | 80.9 | 93 | 99 |
| | W-1600 (VI) | | | | | | | | |
| | Control | | | .0464 | .049 | | | | |
| 241 | 50 PAMVCH + .7% Acryloid | .0908 | .0480 | | | 6.79 | 55.38 | 72 | 80 |
| | 50 PIB W-1600 (VI) | | | | | | | | |
| 242 | 50 PAMVCH + .4% Acryloid | | | .0464 | .049 | 9.09 | 67.1 | 112 | 122 |
| | 50 PIB W-1600 VI | | | | | | | | |
| | Control | | | .0472 | .048 | | | | |
| 243 | PAMVCH + Trac Pkg | | .0615 | | | | | | |
| | Control | | .0620 | | | | | | |
| 244 | 50 PAMVCH + Trac Pkg | .0850 | .0315 | | | 4.72 | 33.42 | 447 | 40 |
| | 50 Polyvis | | | | | | | | |
| | Control | | .0515 | | | | | | |
| 245 | 80 PAMVCH + Trac Pkg | | .0545 | | | | | | |
| | 40 Oronite | | | | | | | | |
| | Control | | .0560 | | | | | | |

-continued

| | | | | | | | |
|---|---|---|---|---|---|---|---|
| 246 | 75 PAMVCH + Trac Pkg<br>25 Oronite | .0570 | | | | | |
| | Control | .0580 | | | | | |
| 247 | 60 PAMVCH +]Trac Pkg<br>40 Oronite | .0877 | | 5.15 | 41.34 | 32 | 31 |

| Pkg Y |
|---|
| 1/2% DuPont PAM |
| 1/2% DuPont Ortholeum 304 |
| 1% Stauffer TCP (EP) |

| | Fluid | 0°F | −20°F | Brookfield Mol. Wt. | $T_g$, °C | Density | Pour Pt °F |
|---|---|---|---|---|---|---|---|
| | Styrenes | | | | | | |
| 1 | PAMVCH (50% Indan) | | | 276 | −56 | | +15 |
| 2 | PAMVCH (95% Indan) | | | | −66 | .9428 | −5 |
| 3 | PAMVCH (cis-Indan) | | | | | | |
| 4 | PAMVCH (trans-Indan) | | | | | | |
| 5 | PAMVCH | 15,200 | | | | .9328 | −10 |
| 6 | PAMVCH | 20,000 | | | | | −15 |
| 7 | PAMVCH | | | | | | |
| 8 | PAMVCH (5.5% Trimer) | | | 251 | −68 | .9398 | −5 |
| 9 | PAMVCH | 49,250 | | | | .9393 | −10 |
| 10 | PAMVCH | ($KV_0$ 85,832) | | | | | −5 |
| 11 | PAMVCH | 100,000 | | | | | |
| 12 | PAMVCH | | | | | | |
| 13 | PAMVCH (24.8% Trimer) | | | | | | |
| 14 | Dow PAMVCH | | | | | | −10 |
| 15 | PAMVCH | | | | | | |
| 16 | PAMVCH (Mostly Trimer) | | | | | | |
| 17 | PAMVCH Trimer (Indan) | | | | | | |
| 18 | PVCH | | | | | | |
| 19 | PVCH | | | 247 | −75 | .9062 | −30 |
| 20 | PVCH | | | 295,316 | −54 | .9222 | −5 |
| 21 | PAMS | | | | | | |
| 22 | PAMS | | | 273 | −48 | | +15 |
| 23 | PAMS | | | | | | |
| | Polybutenes | | | | | | |
| 24 | Polyvis - OSH | | | | −88 | .8267 | −60 |
| 25 | Polyvis - Hyd. | ($KV_0$ 1900 | $KV_{-20}$ 8801 | $KV_{-40}$ 57,300) | | | −45 |
| 26 | Polyvis - Hyd. | $KV_0$ 2180 | | | −95 | .8219 | |
| 27 | Polyvis - Hyd. | | | | | | |
| 28 | Polyvis - Hyd. | | | | | | −40 |
| 29 | Polyvis - Hyd. | | | | | | |
| 30 | Polyvis - Hyd. | | | | | | |
| 31 | Polyvis - Hyd. | | | | −93 | .8238 | −50 |
| 32 | Indopol - Hyd. | | | | | | −60 |
| 33 | Indopol - Hyd. | | | | | | |
| 34 | Oronite - Partially Hyd. | | | | | | |
| 35 | Oronite - Hyd. | | | | −110 | | −60 |
| 36 | Oronite - Hyd. | 410 | | | | | |
| 37 | Oronite - Hyd. | | | | | | |
| 38 | Oronite - Hyd. | | | | | | |
| 39 | Oronite - Hyd. | 460 | | | | | |
| 40 | PIB - Hyd. | | | | | | |
| 41 | PIB - Hyd. | 160 | 560 | (1910 cp at −40°F) | | | |
| 42 | PIB - Hyd. | | | | | | |
| 43 | PIB - Hyd. | | | | | | |
| 44 | PIB - Hyd. | | | | | .8393 | −45 |
| 45 | PIB - Hyd. | $KV_0$ 1742 | | | | | |
| 46 | PIB - Hyd. | | | | −112 | .8505 | −60 |
| 47 | PIB - Hyd. | | | | | | |
| | Well Characterized Compounds | | | | | | |
| 48 | Octacosane | | | | | | |
| 49 | Ethylene/Propylene 56/44 | | | 555 | −96 | .8245 | −15 |
| 50 | Polypropylene | | | | −79 | .8107 | −15 |
| 51 | Polypropylene | | | | −67 | .8159 | −30 |
| 52 | Polypropylene | | | | −64 | .8233 | −25 |
| 53 | Propylene/1-butene 51/49 | | | 466 | −83 | .8191 | −25 |
| 54 | Poly(1-butene) | | | | −84 | .8325 | −35 |
| 55 | Poly(1-butene) | | | 557 | −82 | .8329 | |
| 56 | Poly(1-pentene) | | | | | | |
| 57 | Poly(1-hexene) | | | | −93 | .8230 | −70 |
| 58 | Poly(1-octene) | 348 | 860 | 465 | −106 | | −80 |
| 59 | Poly(1-octene) | | | 465 | | | −65 |
| 60 | Poly 1,3(3-methylbutene-1) | | | 361 | −87 | | −25 |
| 61 | Poly(4-methylpentene-1) | | | 433 | −86 | .8139 | −50 |
| 62 | Poly(2,3-dimethylbutene-1) | | | | | | |
| 63 | Poly(2,3-dimethylbutene-1) | | | | −74 | .8393 | +10 |
| 64 | Tetraisopropyldecalin-Hyd. | | | | | | |
| 65 | Tetraisopropyldecalin-Hyd. | | | | | | |
| 66 | Tetraisopropyldecalin-Hyd. | | | | −48 | | +10 |
| 67 | Tetraisopropyldecalin-Hyd. | | | | | | |
| 68 | Hyd. o-terphenyl | | | 240 | −59 | | −5 |
| 69 | Hyd. o-terphenyl | | | | | | |

-continued

| | | | | | | | |
|---|---|---|---|---|---|---|---|
| 70 | Hyd. p-terphenyl | | | 204 | | | −26 |
| 71 | Dimethyladamantane | | | | −40 | | |
| 72 | DMA Dimer | | | 224 | | | −52 |
| 73 | Ethyladamantane | | | | −87 | .9729 | −70 |
| 74 | DMA Dipelargonate | | | | −86 | | |
| 75 | DMA Dicaprolate | (KV-40 44 490) | | | −119 | | |
| 76 | Cyclopentyl DMA | | | | −101 | | |
| 77 | Perhydrophenanthrene | | | | −54 | | 0 |
| 78 | Hyd. 9-benzylidene fluorene | | | | | | |
| 79 | Di-2-ethylhexylsebacate | | | | | | |
| 80 | Di-indene | | | | | | |
| | Poorly Characterized Fluids | | | | | | |
| 81 | Monsanto HB-40 | | | | | | −5 |
| 82 | Amoco BM-1 | | | | | | −30 |
| 83 | Hyd. Amoco BM-1 | | | 275 | −58 | | +35 |
| 84 | Hyd. Formolite | | | | | | −50 |
| 85 | Dixylyl methane-Hyd. | | | | | | +20 |
| 86 | Tritotyl dimethane-Hyd. | | | | | | |
| 87 | Ditetralyl Methane -Hyd. | | | | | | +30 |
| 88 | Trixylyl Dimethane-Hyd. | | | | | | |
| 89 | 4-Ring Formolite-Hyd. | | | | − 100 | | |
| 90 | Hyd. Transil Stock | | | 304 | −77 | | −30 |
| 91 | Circolite | | | | | | −30 |
| 92 | Circolite | | | 371 | −79 | | −35 |
| 93 | Hyd. Circolite | | | 324 | −81 | | −25 |
| 94 | New 98 Golden | | | 330 | −84 | | −40 |
| 95 | Hyd. New 98 Golden | | | | −84 | | −55 |
| 96 | Hyd. New 98 Golden | | | | | | −45 |
| 97 | Hyd. New 91 Golden | | | 308 | −63.5 | | −10 |
| 98 | Hyd. 3-G Extract | | | | | | |
| 99 | SunVis 11 | | | | | | |
| 100 | Hyd. SunVis 11 | | | | | | |
| 101 | Hyd. SunVis 11 | | | | | | |
| 102 | Hyd. Resin Piccolyte S-10 | | | | | | −15 |
| 103 | Hyd. Piccovar AP10 | | | | | | 0 |
| 104 | Coal Tar Distillate | | | | | | −30 |
| 105 | Coal Tar Distillate -Hyd. | | | | | | |
| 106 | Syn. Lube Care Lab 321 | | | | | | |
| | PAMVCH/Polyisobutylene - Hyd. | | | | | | |
| 107 | 30/70 506566/506649-10 | | | | −89 | | −20 |
| 108 | 50/50 485564/485555-1 | | | | −93 | .8993 | −35 |
| 109 | 50/50 506581/532570-10 | 2130 | 5570 | (71,200 at −40) | | | |
| 110 | 50/50 506566/632645-1 | 1110 | 4760 | (51,500 at −40) | | | |
| 8 | PAMVCH | | | | −68 | .9398 | −5 |
| 111 | 95/5 506566/532570-10 | | | | | .9318 | |
| 112 | 90/10 506566/532570-10 | | | | | .9180 | |
| 113 | 80/20 506566/532570-10 | | | | | .9119 | −35 |
| 114 | 70/30 506566/532570-10 | | | | | .8982 | |
| 115 | 60/40 506566/532570-10 | | | | | .8903 | −40 |
| 116 | 50/50 506566/532570-10 | | | | | .8676 | |
| 117 | 40/60 506566/532570-10 | | | | | .8696 | −40 |
| 118 | 30/70 506566/532570-10 | | | | | .8611 | |
| 119 | 20/80 506566/532570-10 | | | | | .8527 | |
| 120 | 10/90 506566/532570-10 | | | | | .8393 | −45 |
| 44 | PIB | | | | | | |
| | PAMVCH Trimer/Polyisobutylene - | | | | | | −30 |
| 121 | 30/70 506567-10/532538-10 | | | | −105 | | −25 |
| 122 | 30/70 t06592/506649-10 | | | | | | |
| | PAMVCH/Polyvis-OSH | | | | | | |
| 123 | 50/50 485658/475766 | 5650 | 45,362 | 339 | −81 | .8825 | −50 |
| | PAMVCH/Polyvis - Hyd. | | | | | | |
| 124 | 10/90 506566/506563 | | | | −95 | .8346 | −30 |
| 125 | 30/70 506520/506509-2 | 3872 | | | −88.5 | .8582 | −35 |
| 126 | 50/50 506520/506509-2 | 6309 | | | −83 | .8819 | −20 |
| 127 | 50/50 506566/506563 | 4,813 | 34,150 | 283 | −87 | .8622 | −25 |
| 128 | 50/50 506566/532610 | 5,160 | 46,500 | | | | |
| 129 | 50/50 (Cleaned up 714-35) | | | | | | |
| 8 | PAMVCH | | | 251 | −68 | | −5 |
| 130 | 50/50 506566/532591-1 | | | | | | |
| 29 | Polyvis - Hyd. | | | | | | |
| 8 | PAMVCH | | | 251 | −68 | | −5 |
| 131 | 90/10 506566/506563 | | | | −72 | .9249 | |
| 132 | 75/25 506566/506563 | | | | −78 | .9104 | |
| 133 | 50/50 506566/506563 | 4,813 | | 283 | −87 | .8822 | −25 |
| 134 | 25/75 506566/506563 | | | | −93 | .8514 | |
| 135 | 10/90 506566/506563 | | | | −97 | .8362 | |
| 26 | Polyvis - Hyd. | | | | −95 | .8219 | |
| | PAMVCH/Indopol - Hyd. | | | | | | |
| 136 | 45/55 506581/506626-1 | 1533 | 8,875 | 26,319 | −90 | | −35 |
| 137 | 50/50 506566/532622 | 3160 | 18,000 | 100,000 | −68 | | |
| 8 | PAMVCH | | | (251) | −68 | | −5 |
| 138 | 50/50 506566/506626-1 | | | | | | |
| 32 | Indopol - Hyd. | | | | | | |
| | PAMVCH/Oronite - Hyd. | | | | | | |
| 139 | 50/50 506566/532624 | 2,160 | 5710 | | | | |
| 140 | 46/54 532(46-4/502680-1 | 1,710 | 9,700 | 85,000 | | | −45 |

-continued

| | | | | | | | |
|---|---|---|---|---|---|---|---|
| 141 | 50/50 506544/532680-1 | 2,460 | 15,000 | 100,000 | | | −45 |
| 142 | 61/39 506544/532680-1 | 4,010 | 33,00 | 100,000 | | | −45 |
| 143 | 60/40 544510/1-532680-1 | 8,460 | 79,500 | | | | −35 |
| 144 | 75/25 544510/1-532680-1 | 30,250 | 100,000 | | | | −15 |
| 145 | 50/50 32670-3/532680-1 | | | | | | |
| 8 | PAMVCH | | | 251 | −68 | | −5 |
| 146 | 50/50 506566/506515 | | | | | | |
| 35 | Oronite | | | | −110 | | |
| 5 | PAMVCH (3.81) | 15,200 | | | | .9328 | −10 |
| 147 | 75/25 532670-3/532677 | 3,500 | | | | | −25 |
| 148 | 50/50 532670-3/532677 | 1,260 | | | | | −50 |
| 149 | 25/75 532670-3/532677 | 660 | | | | | −60 |
| 36 | Oronite | 410 | | | | .8240 | −75 |
| 9 | PAMVCH (450) | 49,250 | | | | .9393 | −10 |
| 150 | 75/25 532646-4/532677 | 7,260 | | | | | |
| 151 | 50/50 532646-4/532677 | 1,960 | | | | | |
| 152 | 25/75 532646-4/532677 | 810 | | | | | |
| 36 | Oronite | 410 | | | | .8240 | −75 |
| 11 | PAMVCH (508) | 100,000 | | | | .9416 | −10 |
| 153 | 75/25 506544/532677 | 11,400 | | | | | |
| 154 | 50/50 506544/532677 | 2,500 | | | | | |
| 155 | 25/75 506544/532677 | 1,110 | | | | | |
| 36 | Oronite | 410 | | | | | |
| 13 | PAMVCH (682) | | | | | | |
| 156 | 75/25 544510-1/532680-1 | 40,250 | | | | | |
| 157 | 50/50 544510-1/532680-1 | 4,960 | | | | | |
| 158 | 25/75 544510-1/532680-1 | 1,360 | | | | | |
| 38 | Oronite | | | | | | |
| | PAMVCH/Oronite - Partially Hyd. | | | | | | |
| 159 | 50/50 532670-3/532680-2 | | | | | | |
| | Hyd. Polystyrene/Polyisobutylene | | | | | | |
| 160 | 170 PVCH | | | 281 | −85 | .8907 | −30 |
| | 30 PIB | | | | | | |
| 161 | 50 PVCH | | | 310 | −94 | .8793 | −30 |
| | 50 PIB | | | | | | |
| 162 | 30 PVCH | | | 323 | −102 | .8632 | −30 |
| | 70 PIB | | | | | | |
| 163 | 50 PVCH 485687-1 | (KV-65 9,860) | | | | | |
| | 70 PIB 544525-2 | | | | | | |
| | Polyisobutylene/Polyvis Hyd. | | | | | | |
| 164 | 50 506649-10 | | | | −112 | | −25 |
| | 50 506679-10 | | | | | | |
| 165 | 50 532538-10 | | | | | | −30 |
| | 50 506679-10 | | | | | | |
| 166 | 50 532645-1 | 660 | 2060 | (8,800 | −40) | | |
| | 50 532610 | | | | | | |
| 44 | PIB | | | | | | |
| 167 | 90/10 532570-10/532610 | | | | | | |
| 168 | 80/20 532570-10/532610 | | | | | | |
| 169 | 70/30 532570-10/532610 | | | | | | |
| 170 | 60/40 532570-10/532610 | | | | | | |
| 171 | 50/50 532570-10/532610 | | | | | | |
| 172 | 40/60 532570-10/532610 | | | | | | |
| 173 | 30/70 532570-10/532610 | | | | | | |
| 174 | 20/80 532570-10/532610 | | | | | | |
| 175 | 10/90 532570-10/53610 | | | | | | |
| 30 | Polyvis | | | | | | |
| | Polyisobutylene/Polybutene | | | | | | |
| 176 | 50 PIB 532570-10 | | | | | | |
| | 50 Indopol 506626-1 | | | | | | |
| 177 | 50 PIB 532570-10 | | | | | | |
| | 50 Oronite 506315 | | | | | | |
| | Miscellaneous Blends | | | | | | |
| | Cyclohexyl DMA | | | | | | |
| 178 | 67/33 532655-2/544516 | | | | | | |
| 179 | 40/60 532655-2/544516 | | | | | | |
| 39 | Oronite | | | | | | |
| 17 | PAMVCH Trimer | | | | | | |
| 180 | 67/33 506592/544516 | | | | | | |
| 181 | 40/60 506592/544516 | | | | | | |
| 39 | Oronite | | | | | | |
| 72 | DMA Dimer | | | | −40 | | |
| 182 | 75/25 41568-1/544516 | | | | | | |
| 183 | 49/51 41568-1/544516 | (18,026 - $KV_0$) | | | | | |
| 184 | 30/70 41568-1/532680-1 | (4,852 - $KV_0$ | | | | | |
| 39 | Oronite | | | | | | |
| 185 | 40 PVCH | | | 367 | −80 | | |
| | 60 Polypropylene | | | | | | |
| 186 | 5 PAMS 506580-6 | | | | −70 | | −10 |
| | 95 PAMVCH 506566 | | | | | | |
| 187 | .75 PAMS 532572-1 | | | | | | |
| | 99 PAMVCH 506566 | | | | | | |
| 188 | 5 PAMS 532572-1 | | | | | | |
| | 95 PAMVCH 506566 | | | | | | |
| 189 | 10 PAMS 532572-1 | | | | | | |
| | 90 PAMVCH | | | | | | |
| 190 | 60 PAMS 532572-1 | | | | | | |
| | 40 PAMVCH 506566 | | | | | | |
| 191 | 70 Formolite 4R 532566-2 | | | | | | |

-continued

| | | | | | | |
|---|---|---|---|---|---|---|
| | 30 PIB 532570-10 | | | | | |
| 192 | 50 Hyd New 98G 506510-3 | | | | −104 | −45 |
| | 50 PIB 506518 | | | | | |
| 193 | 50 Hyd New 98G 4885590 | | | | −90 | −30 |
| | 50 Polyvis Hyd 506563 | | | | | |
| 194 | 15 PAMVCH 485594 | | | 313 | −84 | −25 |
| | 85 New 91G Hyd 485593 | | | | | |
| 195 | 50 PAMVCH 506566 | | | | −76 | |
| | 50 New 98G Hyd 485590 | | | | | |
| 196 | 50 PAMVCH 506581 | | | | −89 | −50 |
| | 50 Hyd Sunvisll 506611-3 | | | | | |
| 197 | 50 PAMVCH 506581 | | | | −85 | |
| | 50 Hyd Transil 506582 | | | | | |
| 198 | 50 PAMVCH 506566 | 848 | 3,233 | 17,595 | −97 | |
| | 50 18-H 506623-1 | | | | | |
| 199 | 50 18-H 506623-1 | 615.8 | 1,873 | 7,335 | −107 | |
| | 50 Polyvis 506627-10 | | | | | |
| 200 | 25 18-H 506623-1 | | | | −122 | |
| | 75 PIB 506649-1 | | | | | |
| 201 | 50 Poly(2,3DMB-1) 506681 | | | | −106 | |
| | 50 PIB 506649-1 | | | | | |
| 202 | 50 Polypentene 485501-10 | | | | | |
| | 50 Oronite 532680-1 | | | | | |
| 203 | 50 Poly(2,3DMB-1) 506681 | | | | −88 | |
| | 50 Polyvis 506679-1 | | | | | |
| 204 | 10 TIPD 506636-2 | | | | −57 | −40 |
| | 90 Polyvis 506622-10 | | | | | |
| 205 | 30 TIPD 506583 | | | | −88 | |
| | 70 Polyvis 506563 | | | | | |
| 206 | 50 TIPD 506583 | | | | −78 | |
| | 50 Polyvis 506563 | | | | | |
| 207 | 70 TIPD 506636-2 | | | | −66 | −5 |
| | Polyvis 506622-10 | | | | | |
| 208 | 10 Hy.O-Terphen 532506 | | | | −89 | |
| | 90 Polyvis 506679-10 | | | | | |
| 209 | 10 Hy.P-Terphen 506669 | | | | −95 | |
| | 90 Polyvis 506679-10 | | | | | |
| 210 | 30 Hy.O-Terphen 532506 | | | | −105 | |
| | 70 PIB 506649-10 | | | | | |
| 211 | 30 Hy.O-Terphen 532506 | | | | −85 | |
| | 70 Polyvis 506679-10 | | | | | |
| 212 | 50 Hy.O-Terphen 532506 | | | | | |
| | 50 PIB 532538-10 | | | | | |
| 213 | 50 Hy.O-Terphen 532616 | 1,460 | 31,500 | | | |
| | 50 PIB 532538-10 | | | | | |
| 214 | 50 Hy.O-Terphen 532506 | | | | −79 | |
| | 50 Polyvis 506679-10 | | | | | |
| 215 | 33 PAMVCH 506566 | KV | $KV_{-30}$ | $KV_{-40}$ | −95 | |
| | 33 Polyoctene 506623-1 | 1026 | 4,062 | 24,617 | | |
| | 33 Polyvis 506622-10 | | | | | |
| 216 | 33 PAMVCH 506566 | 1,460 | 5,310 | 32,250 | | |
| | 33 Polyvis 532610 | | | | | |
| | 33 PIB 532645 | | | | | |
| 217 | 33 PAMVCH 506566 | | | | | |
| | 33 PIB 532570-10 | | | | | |
| | 33 Polyvis 532610 | | | | | |
| 218 | 50 PAMVCH 506566 | | | | | |
| | 25 PIB 532570-10 | | | | | |
| | 25 Polyvis 532610 | | | | | |
| 219 | 50 PAMVCH 506566 | | | | | |
| | 45 PIB 532570-10 | | | | | |
| | 5 Polyvis 532610 | | | | | |
| 220 | 25 PAMVCH 506566 | | | | | |
| | 70 PIB 532570-10 | | | | | |
| | 5 Polyvis 532610 | | | | | |
| 221 | 85 PAMVCH 506566 | | | | | |
| | 5 PIB 532570-10 | | | | | |
| | 10 Polyvis 532610 | | | | | |
| 222 | 15 PAMVCH 506566 | | | | | |
| | 15 PIB 532570-10 | | | | | |
| | 70 Polyvis 532610 | | | | | |
| 223 | 33 PAMVCH 506566 | | | | | |
| | 33 PIB 532570/10 | | | | | |
| | 33 Indopol 506626-1 | | | | | |
| | Additives | | | | | |
| 224 | 1/2% Ethyl 702 | | | | | |
| 225 | 2% Acryloid 983 (disper.) | | | | | |
| 226 | 1/2% TCP (EP) | | | | | |
| 227 | 1/2% NASUL BSN (REC) | | | | | |
| 228 | All above four | | | | | |
| 229 | 1/2% LZ 1360 (EP) | Trac Pkg | | | | |
| 230 | 1/2% Ultraphos (EP) | 1/2% Ethyl 702 (Antioxid.) | | | | |
| | | 1/2% Stauffer TCP (EP) | | | | |
| | | 1/2% NaSul BSN (R & C) | | | | |
| 231 | 4.7% LZ 284 (GM pkg) | 2% LZ 895 (Dispersant | | | | |
| 232 | 6.75% K236 (New Ford pkg) | | | | | |
| 233 | 5.0% LZ 280 (Old Ford pkg) | | | | | |
| 234 | 2% LZ 895 (disper.) | | | | | |
| 235 | Trac Pkg | | | | | |
| 236 | 20% Cyclohexanol | | | | | |
| 237 | PAMVCH + .1% Valeric Acid | | | | −68 | −5 |
| | Control | | | | | |
| 238 | New 98 Golden +Pkg Y | | | | | |
| | Control | | | | | |

-continued

| | | | | | |
|---|---|---|---|---|---|
| 239 | PAMVCH + 2.7% Acryloid W-1600 (VI) | 46,250 | | 266 | −20 |
| 240 | PAMVCH + 5% Acryloid W-1600 (VI) Control | | | | |
| 241 | 50 PAMVCH + .7% Acryloid 50 PIB W-1600 (VI) | | | | |
| 242 | 50 PAMVCH + .4% Acryloid 50 PIB W-1600 VI Control | | | | −35 |
| 243 | PAMVCH + Trac Pkg Control | | | | |
| 244 | 50 PAMVCH + Trac Pkg 50 Polyvis Control | 6,310 | 45,250 | | |
| 245 | 60 PAMVCH + Trac Pkg 40 Oronite Control | | | | |
| 246 | 75 PAMVCH + Trac Pkg 25 Oronite Control | | | | |
| 247 | 60 PAMVCH + Trac Pkg 40 Oronite | 11,656 - $KV_0$ | | | |

The invention claimed is:

1. A composition useful as a base stock for a lubricant in a traction drive transmission, said composition having a kinematic viscosity at 210°F in the range of 1.5–200.0 cs. and comprising A. from 1–25 parts by weight of a hydrogenated polymer of $C_3$–$C_8$ aliphatic hydrocarbyl monoolefin, said polymer having an average molecular weight in the range of 180–2000, and B. one part by weight of an adamantane compound selected from:

a. an ether having the formula

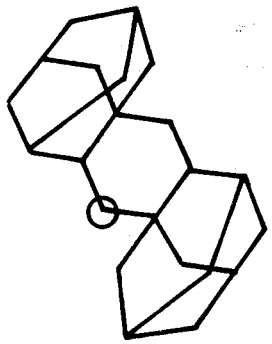

Trans-type or

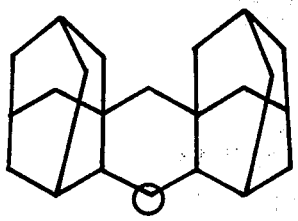

Cis-type and b. an alkyl-substituted derivative of said ethers.

2. The composition of claim 1 wherein said hydrogenated polymer of $C_3$–$C_8$ olefin is a polymeric oil which is substantially free from unsaturation and has an average molecular weight in the range of 200–1000.

3. The composition of claim 2 wherein said polymeric oil has a bromine number no greater than 5.

4. The composition of claim 3 wherein said monoolefin consists essentially of isobutylene.

5. The composition of claim 1 wherein said alkyl-substituted derivative contains from 2–6 methyl groups, all attached to bridgehead carbon atoms.

6. The composition of claim 1 wherein said paraffinic petroleum oil is a hydrogenated oil.

7. The composition of claim 2 wherein said paraffinic petroleum oil is a hydrogenated oil.

* * * * *